US008109626B2

(12) United States Patent
Doi et al.

(10) Patent No.: US 8,109,626 B2
(45) Date of Patent: Feb. 7, 2012

(54) RECORDING DEVICE AND INK RECEIVING PARTICLES

(75) Inventors: Takatsugu Doi, Kanagawa (JP); Ken Hashimoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 914 days.

(21) Appl. No.: 12/127,135

(22) Filed: May 27, 2008

(65) Prior Publication Data

US 2009/0091610 A1 Apr. 9, 2009

(30) Foreign Application Priority Data

Oct. 3, 2007 (JP) ..... 2007-259542

(51) Int. Cl.
*B41J 2/01* (2006.01)

(52) U.S. Cl. ..... 347/103; 399/357

(58) Field of Classification Search ..... 347/101–103; 399/343, 349, 357
See application file for complete search history.

(56) References Cited

U.S. PATENT DOCUMENTS 6,716,562 B2 * 4/2004 Uehara et al. ..... 430/125.3
7,281,790 B2 * 10/2007 Mouri et al. ..... 347/103
7,661,809 B2 * 2/2010 Taniuchi et al. ..... 347/103

FOREIGN PATENT DOCUMENTS

JP 2006-347085 12/2006

* cited by examiner

*Primary Examiner* — Daniel Petkovsek
(74) *Attorney, Agent, or Firm* — Fildes & Outland, P.C.

(57) ABSTRACT

A recording device including: an intermediate transfer member; a particle supply unit that supplies ink receiving particles that receive ink onto the intermediate transfer member; an ink ejecting unit that ejects ink to the ink receiving particles that have been supplied onto the intermediate transfer member; a transfer unit that transfers the ink receiving particles that have received the ink to a recording medium from the intermediate transfer member; a cleaning unit that cleans the ink receiving particles remaining on the intermediate transfer member after the transfer of the ink receiving particles by the transfer unit; and a cleaning aid particle supply unit that supplies cleaning aid particles.

6 Claims, 6 Drawing Sheets

RECORDING DEVICE AND INK RECEIVING PARTICLES

CROSS-REFERENCE TO RELATED APPLICATION

This application is based on and claims priority under 35 USC 119 from Japanese Patent Application No. 2007-259542 filed Oct. 3, 2007.

BACKGROUND

1. Technical Field

The present invention relates to a recording device and ink receiving particles.

2. Related Art

The ink jet recording method is known as one of the methods of recording images and data using ink. The mechanism of the ink jet recording method is such that the ink in the form of a liquid or a melted solid is ejected from a nozzle, slit, porous film or the like onto paper, cloth, film or the like to record. As a method of ejecting ink, there have been proposed various methods such as a charge control method in which ink is ejected by electrostatic attraction force; a pressure pulse method in which ink is ejected by oscillation pressure of piezo elements; and a thermal ink jet method in which ink is ejected by pressure generated by forming and growing of air bubbles under high temperature. Images or data of extremely high definition can be recorded by these methods.

Among the recording methods using ink, including these ink jet recording methods, there have been proposed a method in which an image is first recorded on an intermediate member, and the image is then transferred onto a recording medium, in order to record an image with high image quality on various types of recording media such as permeable media and impermeable media.

SUMMARY

According to an aspect of the invention, there is provided a recording device comprising an intermediate transfer member, a particle supply unit for supplying ink receiving particles that receive ink to the intermediate transfer member, an ink ejecting unit for ejecting ink to the ink receiving particles supplied to the intermediate transfer member, a transfer unit for transferring the ink receiving particles that have received the ink to a recording medium from the intermediate transfer member, a cleaner for cleaning the ink receiving particles remained on the intermediate transfer member after the transfer by the transfer unit, and a cleaning aid particle supply unit for supplying cleaning aid particles.

BRIEF DESCRIPTION OF THE DRAWINGS

Exemplary embodiments of the present invention will be described in detail based on the following figures, wherein.

DETAILED DESCRIPTION

In the following, some exemplary embodiments of the invention will be described with reference to the drawings. Elements having substantially the same effects or functions are represented by the same reference marks in all of the drawings, and overlapping descriptions thereof may be omitted in some cases.

Figure 1:
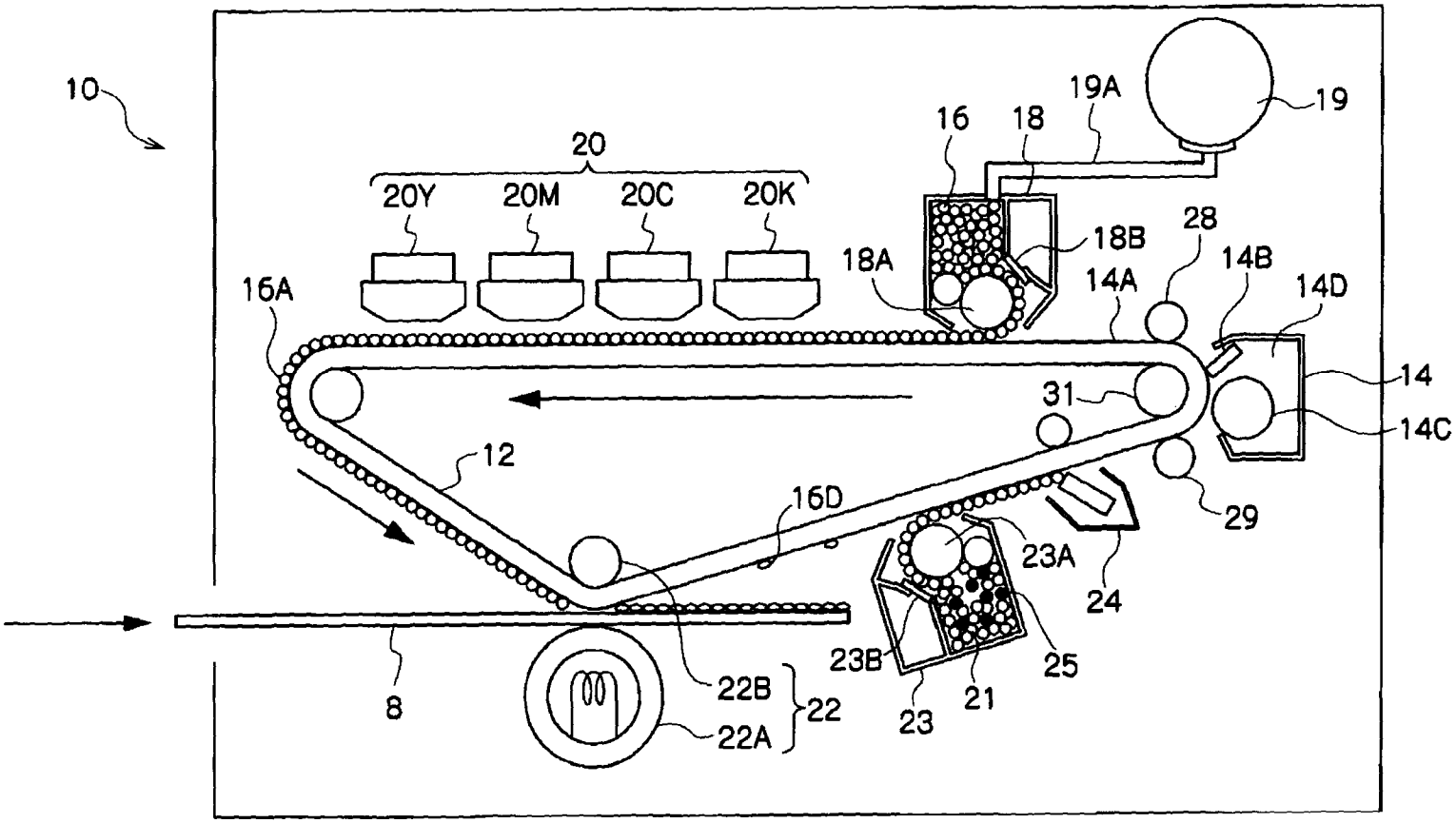
FIG. 1 is a configurational drawing showing a recording device according to an exemplary embodiment of the invention.
Figure 2:
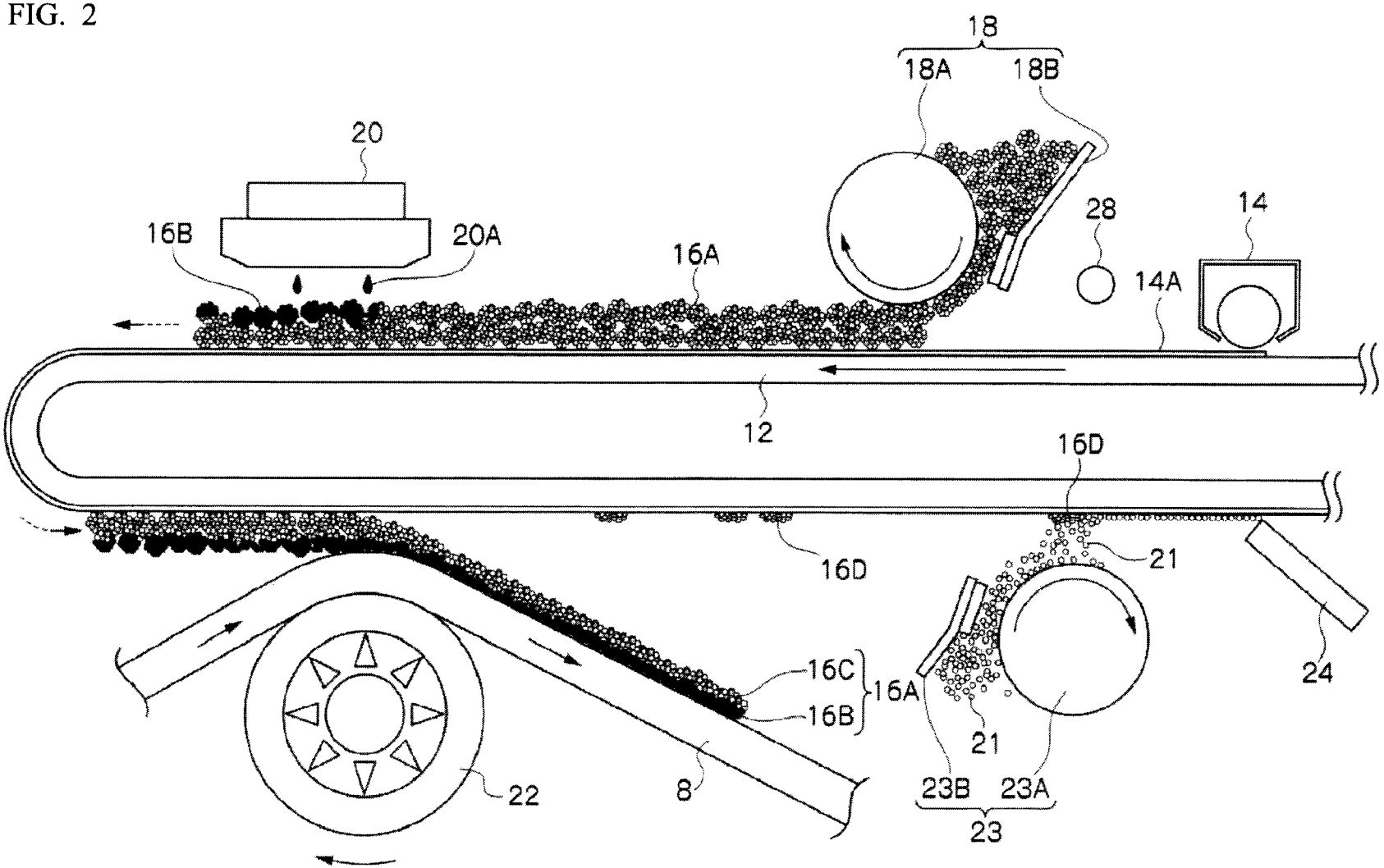
FIG. 2 is a configurational drawing showing a main part of a recording device according to an exemplary embodiment of the invention.
Figure 3A:
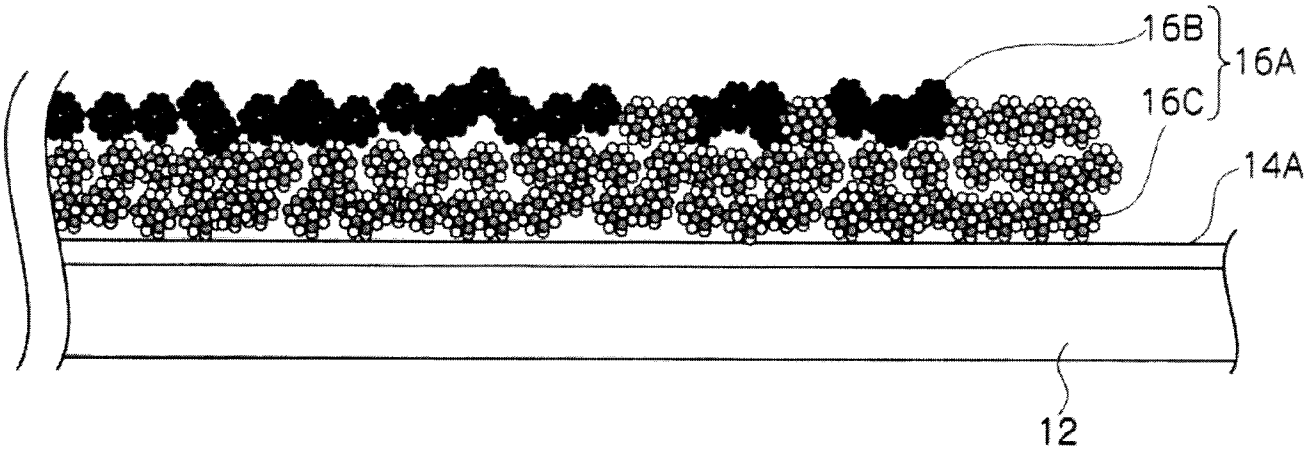
FIGS. 3A and 3B are configurational drawings showing ink receiving layers according to an exemplary embodiment of the invention respectively.
Figure 3B:
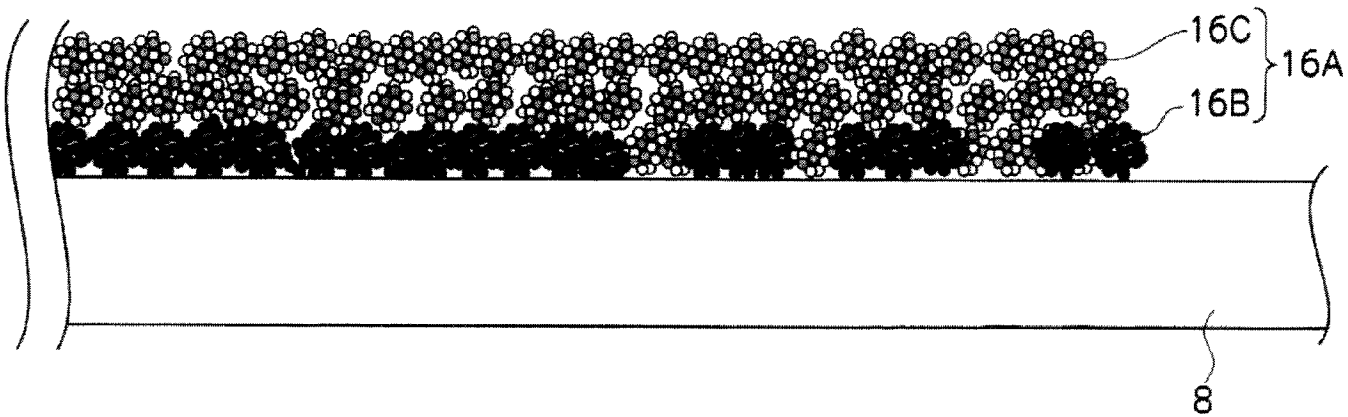

FIG. 1 is a configurational drawing showing a recording device according to a first embodiment. FIG. 2 is a configurational drawing showing a main part of the recording device according to the first embodiment. FIGS. 3A and 3B are configurational drawings showing ink receiving particle layers according to the first embodiment. In the first embodiment, explanation will be given according to a case where composite particles are used as the ink receiving particles described later.

As shown in FIG. 1, a recording device 10 according to the first embodiment includes an intermediate transfer member 12 in the form of an endless belt, a charger 28 that charges the surface of the intermediate transfer member 12, a particle supply unit 18 that feeds ink receiving particles 16 to the charged area of the intermediate transfer member 12 to form a particle layer, an inkjet recording head 20 that ejects ink droplets onto the particle layer to form an image, and a transfer fixing unit 22 that transfers and fixes the layer of the ink receiving particles onto a recording medium 8 by contacting the intermediate transfer member 12 with the recording medium 8 and applying pressure and heat thereto. An ink receiving particle storing cartridge 19 is detachably connected to the particle supply unit 18 via a feed pipe 19A.

A releasing agent supply unit 14 that feeds a releasing agent 14D to form a releasing layer 14A is placed upstream of the charger 28.

The particle supply unit 18 forms a layer of the ink receiving particles 16 on the surface of the intermediate transfer member 12 on which charges have been formed by the charger 28. Ink droplets of the respective colors are ejected onto the particle layer from the inkjet recording heads 20, including the inkjet recording heads 20K, 20C, 20M, and 20Y for respective colors, thereby forming a color image.

The particle layer on which the color image is formed on its surface is transferred to the recording medium 8 by means of the transfer fixing unit (transfer fixing roll) 22 together with the color image. Downstream of the transfer fixing unit 22 is placed a cleaner 24 that removes ink receiving particles 16 remaining on the surface of the intermediate transfer member 12 and other foreign materials adhered to the intermediate transfer member (such as paper powder from the recording medium 8). Between the transfer fixing unit 22 and a cleaner 24 is placed a cleaning aid particle supply unit 23 that feeds cleaning aid particles on the remaining ink receiving particles 16D on the surface of the intermediate transfer member 22.

The recording medium 8 having the transferred color image is conveyed out, and charges are formed again on the surface of the intermediate transfer member 12 by the charger 28. At this time, the ink receiving particles transferred onto the recording medium 8 absorb and retain the ink droplets 20A, thereby enabling speedy feeding out of the recording medium.

If necessary, a charge remover 29 for removing the charges left on the surface of the intermediate transfer member 12 may be placed between the cleaner 24 and the releasing agent supply unit 14 (hereinafter, the phrase "between A and B" indicates any position other than the positions for A and B, unless otherwise stated).

In this embodiment, the intermediate transfer member 12 includes a surface layer of 400 μm-thick ethylene-propylene rubber (EPDM) formed on a base layer made of a 1 mm-thick polyimide film. This surface layer preferably has a surface resistance of about $10^{13}$ Ω/square and a volume resistivity of about $10^{12}$Ω·cm (semiconductivity).

When the intermediate transfer member 12 is rotated, the releasing agent layer 14A is formed first on the surface of the intermediate transfer member 12 by the releasing agent supply unit 14. The releasing agent 14D is supplied onto the surface of the intermediate transfer member 12 by a feed roll 14C of the releasing agent supply unit 14, and the thickness of the releasing agent layer 14A is regulated by a blade 14B.

This structure may be such that the releasing agent supply unit 14 is in contact with the intermediate transfer member 12 in a continuous manner for the purpose of continuously performing image formation and printing, or that the releasing agent supply unit 14 is placed apart from the intermediate transfer member 12.

The releasing agent 14D may be supplied from an independent liquid supply system (not shown) to the releasing agent supply unit 14 so that the releasing agent 14D can be supplied in a continuous manner.

Next, positive charges are applied onto the surface of the intermediate transfer member 12 by the charger 28 so that the surface of the intermediate transfer member 12 is positively charged. In this process, an electric potential is formed by which the ink receiving particles 16 can be supplied and adsorbed onto the surface of the intermediate transfer member 12, by means of an electrostatic force that can be generated between a feed roll 18A of the particle supply unit 18 and the surface of the intermediate transfer member 12.

In this embodiment, the device has such a structure that a voltage is applied by mean of the charger 28 between the charger 28 and a driven roll 31 (connected to the ground) that is placed opposite to the charger 28 via the intermediate transfer member 12, thereby charging the surface of the intermediate transfer member 12.

The charger 28 is a roll-shaped component that includes a rod-shaped stainless steel material and an elastic layer in which an electrical conductivity-imparting material is dispersed (a urethane foam resin) formed on the surface of the rod-shaped material, and has a volume resistivity regulated to be from about $10^6$Ω·cm to about $10^8$Ω·cm. In addition, the surface of the elastic layer is covered with a water- and oil-repellant coating layer (for example, made of a tetrafluoroethylene-perfluoroalkyl vinyl ether copolymer (PFA)) to a thickness of 5 μm or more and 100 μm or less.

The charger 28 is connected to a DC power source, and the driven roll 31 is electrically connected to the frame ground. The charger 28 is driven while holding the intermediate transfer member 12 between the driven roll 31 and the charger 28. At the pressing site, a predetermined degree of potential difference is generated between the charger 28 and the grounded driven roll 31, by which charges can be applied to the surface of the intermediate transfer member 12. In this embodiment, for example, the surface of the intermediate transfer member 12 is charged by applying a voltage of 1 kV onto the surface of the intermediate transfer member 12 by the charger 28.

The charger 28 may be a corotron or the like.

The ink receiving particles 16 are then fed from the particle supply unit 18 to the surface of the intermediate transfer member 12 to form an ink receiving particle layer 16A. The particle supply unit 18 includes, in a vessel storing the ink receiving particles 16, a feed roll 18A placed opposite to the intermediate transfer member 12 and a charging blade 18B placed so as to apply pressure to the feed roll 18A. The charging blade 18B also have the function of controlling the thickness of the layer formed by ink receiving particles 16 supplied onto the surface of the feed roll 18A.

When the ink receiving particles 16 are supplied to the feed roll 18A (conductive roll), the ink receiving particle layer 16A is regulated by the charging blade 18B (conductive blade) and is negatively charged, i.e., provided with the polarity opposite to that of the charges on the surface of the intermediate transfer member 12. For example, an aluminum solid roll may be used as the feed roll 18A, and a metal plate (such as a SUS plate) with a urethane rubber for pressing may be used as the charging blade 18B. The charging blade 18B is in contact with the feed roll 18A by a doctor method.

The charged ink receiving particles 16 form a particle layer consisting of, for example, a single layer, on the surface of the feed roll 18A and are delivered to a site facing the surface of the intermediate transfer member 12, and are then transferred onto the surface of the intermediate transfer member 12 by an electrostatic force formed by the electric field generated by the potential difference between the feed roll 18A adjacent to the above site and the surface of the intermediate transfer member 12.

In this process, the traveling speed of the intermediate transfer member 12 and the rotating speed of the feed roll 18A (the peripheral speed ratio) are relatively set such that a single layer of particles is formed on the surface of the intermediate transfer member 12. The peripheral speed ratio depends on the amount of the charges on the intermediate transfer member 12, the amount of the charges on the ink receiving particles 16, the positional relationship between the feed roll 18A and the intermediate transfer member 12, or other parameters.

By relatively increasing the peripheral speed of the feed roll 18A with reference to the peripheral speed ratio at which a single ink receiving particle layer 16A is formed, the amount of the particles supplied onto the intermediate transfer member 12 can be increased. If the density of the transferred image is low (the ejecting amount of the ink is small; for example, 0.1 g/m$^2$ or more and 1.5 g/m$^2$ or less), the layer thickness is preferably minimized; for example, 1 μm or more and 5 μm or less). If the image density is high (the ejection amount of the ink is large; for example, 4 g/m$^2$ or more and 15 g/m$^2$ or less), the layer thickness is preferably regulated to be a sufficient level for retaining a liquid ink component, e.g., a solvent or a dispersion medium (for example, 10 μm or more and 25 μm or less).

For example, in a case where a character or image is printed with a small ejecting amount of the ink, when an image is formed onto a single ink receiving particle layer on the intermediate transfer member, the image-forming material (pigment) in the ink is trapped on the surface of the ink receiving particle layer on the intermediate transfer member, and is fixed on the surface of the ink receiving particles or in interparticle voids thereof, so that the distribution of the ink in the depth direction is reduced.

For example, when a particle layer 16C is desired as a protective layer on an image layer 16B that will become a final image, the ink receiving particle layer 16A can be formed to a thickness of about three layers and an image is formed with ink on the uppermost layer (see FIG. 3A). In this way, the particle layer 16C of two layers having no image will form a protective layer on the image layer 16B after being transferred and fixed on a recording medium (see FIG. 3B).

When an image is formed with a large ejecting amount of ink, such as an image including secondary or tertiary colors, the ink receiving particles 16 are layered so that there are enough particles to retain a liquid ink component (e.g., a solvent or a dispersion medium), thereby trapping the recording material (e.g., a pigment) to prevent it from reaching the bottom layer. In this case, the ink receiving particles 16 having no image can form a protective layer on the surface of the image after being transferred and fixed, so that the image-forming material (pigment) is not exposed on the surface of the image.

The inkjet recording head 20 then applies ink droplets 20A onto the ink receiving particle layer 16A. The inkjet recording head 20 applies the ink droplets 20A onto a predetermined location according to the given image information.

Finally, the recording medium 8 and the intermediate transfer member 12 are nipped by the transfer fixing unit 22, and pressure and heat are applied to the ink receiving particle layer 16A to transfer it onto the recording medium 8.

The transfer fixing unit 22 includes a heating roll 22A containing a heat source and a pressing roll 22B facing the heating roll 22A via the intermediate transfer member 12, and a contact portion is formed between the heating roll 22A and the pressing roll 22B. An aluminum core coated with a silicone rubber and further coated with a PFA tube, for example, can be used as the heating roll 22A and the pressing roll 22B.

At the contact portion formed between the heating roll 22A and the pressing roll 22B, the ink receiving particle layer 16A is heated by a heater and pressure is applied, and therefore the ink receiving particle layer 16A is transferred and fixed onto the recording medium 8.

In this process, organic resin particles of the ink receiving particles 16 in the non-image area are heated to a temperature of not less than the glass transition temperature (Tg) to be softened (or melted), and the ink receiving particle layer 16A is released from the releasing layer 14A that has been formed on the surface of the intermediate transfer member 12 by pressure, and transferred and fixed onto the recording medium 8. In this process, the transfer fixing ability can be improved by heating. In this embodiment, the temperature of the surface of the heating roll 22A is controlled to be 160° C. In this process, the liquid ink component (a solvent or a dispersion medium) is retained in the ink receiving particle layer 16A even after the transfer, and is fixed. Further, the intermediate transfer member 12 may be pre-heated before entering to the transfer fixing unit 22.

Meanwhile, after the ink receiving particle layer 16A has been transferred and fixed to the recording medium 8 by means of the transfer fixing unit 22, cleaning aid particles 21 are supplied from an aid particle supply unit 23 to the ink receiving particles 16D that are remaining on the intermediate transfer member 12. The cleaning aid particle supply unit 23 has a supply roll 23A at the portion facing the intermediate transfer member 12 in a container containing the cleaning aid particles 21 therein, and a charging blade 23B is disposed so as to be pressed against the supply roll 23A. The charging blade 23B also has a function for regulating the supplying amount (layer thickness) of the cleaning aid particles 21 to be supplied to the surface of the supply roll 23A.

The cleaning aid particles 21 are supplied to the supply roll (conductive roll) 23A, the supplying amount (layer thickness) of the cleaning aid particles 21 to the surface of the supply roll 23A is regulated by the charge blade (conductive blade) 23B, and the cleaning aid particles 21 is charged to negative, which is opposite to that at the surface of the intermediate transfer member 12. As the supply roll 23A, for example, an aluminum solid-core roll may be used, and as the charging blade 23B, a metal plate (stainless steel or the like) with an urethane rubber member for applying pressure to the cleaning aid particles 21 may be used. The charging blade 23B is brought into contact with the supply roll 23A according to a doctor method.

The cleaning aid particles 21 charged by the carrier 25 form a particle layer on the surface of the supply roll 23A and are transported to a portion facing to the surface of the intermediate transfer member 12. When the charged cleaning aid particles 21 come close to the surface of the intermediate transfer member 12, the charged cleaning aid particles 21 move to the surface of the intermediate transfer member 12 with electrostatic action due to an electric field formed by the potential difference between the supply roll 23A and the surface of the intermediate transfer member 12. In this way, the charged cleaning aid particles 21 are supplied from the aid particle supply unit 23 to the ink receiving particles 16D remaining on the intermediate transfer member 12.

In this embodiment, an electrostatic supply unit is applied as the aid particle supply unit 23, but a supply unit employing a vibration method, cylindrical rotation method, air method, adhesive method or the like may also be used.

The vibration method is a method in which a container provided with a number of openings is filled with cleaning aid particles, and is vibrated to disperse the particles from the openings.

The cylindrical rotation method is a method in which a cylinder provided with a number of openings on the outer surface thereof is filled with cleaning aid particles, and is rotated to disperse the particles from the openings.

The air method is a method in which a container is filled with cleaning aid particles, and the particles are dispersed by airflow.

The adhesive method is a method in which a bag made of cloth or non-woven cloth is filled with cleaning aid particles, and the bag is directly pressed against the intermediate transfer member to disperse the particles.

The ink receiving particles 16D supplied with cleaning aid particles 21 are then cleaned by the cleaner 24 from the intermediate transfer member 12.

Any kind of permeable media (such as standard paper and inkjet coated paper) or impermeable media (such as art paper and resin films) may be used as the recording medium 8. The recording medium is not limited to the above and may include other industrial products such as semiconductor substrates.

The process of forming an image in the recording device according to this embodiment will be described in more detail below. As shown in FIG. 2, the releasing layer 14A is formed on the surface of the intermediate transfer member 12 by the releasing agent supply unit 14 in the recording device according to this embodiment. When the base material of the intermediate transfer member 12 is aluminum- or PET-based, formation of the releasing layer 14A is particularly preferred. Alternatively, the surface of the intermediate transfer member 12 in itself may have a releasing ability by using a material of fluororesin- or silicone rubber-based.

The surface of the intermediate transfer member 12 is then charged by the charger 28 to be polarized oppositely to that of the ink receiving particles 16. Thus, the ink receiving particles 16 supplied from the feed roll 18A of the particle supply unit 18 can be electrostatically adsorbed to form a layer of the ink receiving particles 16 on the surface of the intermediate transfer member 12.

The layer of ink receiving particles 16 are then formed on the surface of the intermediate transfer member 12 by means of the feed roll 18A of the particle supply unit 18. For example, the ink receiving particle layer 16A is formed to a thickness of about three layers of the ink receiving particles 16. Specifically, the thickness of the ink receiving particle layer 16A is regulated to a desired degree by the gap between the feed roll 18A and the charging blade 18B, thereby controlling the thickness of the ink receiving particle layer 16A to be transferred to the recording medium 8. Alternatively, the thickness may be controlled by the ratio of the peripheral speeds of the feed roll 18A and the intermediate transfer member 12.

The ink droplets 20A are then ejected onto the formed ink receiving particle layer 16A by the inkjet recording heads 20 of respective colors, driven in a piezoelectric mode, a thermal mode or the like, to form the image layer 16B on the ink receiving particle layer 16A. The ink droplets 20A are ejected from the inkjet recording head 20 into the ink receiving particle layer 16A, and the liquid component of the ink is rapidly absorbed into the voids among the ink receiving particles 16 and into the voids within the ink receiving particles 16, and at the same time, the recording material (such as a pigment) is also trapped on the surface of the ink receiving particles 16 (constituent particles) or in the interparticle voids in the constituent particles of the ink receiving particles 16.

In this process, while the ink liquid component (a solvent or a dispersion medium) in the ink droplets 20A infiltrates into the ink receiving particle layer 16A, the recording material such as a pigment is trapped on the surface of the ink receiving particle layer 16A or in the interparticle voids thereof. In other words, the ink liquid component (a solvent or a dispersion medium) may be allowed to pass through to the back side of the ink receiving particle layer 16A, whereas the recording material such as a pigment is not. Thus, in the process of transferring an image to the recording medium 8, a particle layer 16C to which the recording materials such as a pigment is formed on an image layer 16B. As a result, the particle layer 16C forms a protective layer that seals the surface of the image layer 16B, and an image having a surface on which no recording material is exposed can be formed.

The ink receiving particle layer 16A having the image layer 16B formed thereon is then transferred and fixed from the intermediate transfer member 12 onto the recording medium 8, thereby forming a color image on the recording medium 8. The ink receiving particle layer 16A on the intermediate transfer member 12 is heated and pressed by the transfer fixing unit (a transfer fixing roll) 22 that is heated by a heating means such as a heater, and is transferred onto the recording medium 8.

In this process, the surface irregularities of the image and the glossiness may be regulated by controlling the heating and pressing conditions. Alternatively, the glossiness can be controlled by performing cool separation.

After the ink receiving particle layer 16A has been separated, the residual particles 16D on the surface of the intermediate transfer member 12 are collected by the cleaner 24 (see FIG. 1), and the surface of the intermediate transfer member 12 is charged again by the charger 28, and the ink receiving particles 16 are supplied thereon to form an ink receiving particle layer 16A.

FIG. 3 shows particle layers used in the image formation according to the invention. As shown in FIG. 3A, the releasing layer 14A is formed on the surface of the intermediate transfer member 12.

The ink receiving particles 16 is then formed into one or more layers on the surface of the intermediate transfer member 12, by means of the particle supply unit 18. As described above, the ink receiving particles 16 are preferably stacked in about three layers in a thickness direction of the ink receiving particle layer 16A. The thickness of the ink receiving particle layer 16A to be transferred onto the recording medium 8 is regulated by controlling the ink receiving particle layer 16A to a desired thickness. In this process, the surface of the ink receiving particle layer 16A is smoothed so that image formation (formation of the image layer 16B) by ejecting ink droplets can be performed without problems.

As shown in FIG. 3A, a recording material such as a pigment contained in the ejected ink droplets 20A penetrates into the ink receiving particle layer 16A to an amount of about ⅓ to about half of the total thickness thereof, and under the ink receiving particle layer 16A remains the particle layer 16C into which no recording material such as a pigment has not penetrated.

As shown in FIG. 3B, the ink receiving particle layer 16A formed on the recording medium 8 by heat/press transfer at the transfer fixing unit (transfer fixing roll) 22 includes the image layer 16B and the ink-free particle layer 16C on the image layer 16B, and the layer 16C serves as a kind of protective layer to prevent the image layer 16B from being directly exposed on the surface. Therefore, the ink receiving particles 16 need to be transparent at least after fixation.

The particle layer 16C is heated and pressed by the transfer fixing unit (transfer fixing roll) 22 so that its surface can be smoothed, and also the glossiness of the image surface can be controlled by heating or pressing.

Further, evaporation of the liquid ink component (a solvent or a dispersion medium) trapped in the ink receiving particles 16 may be enhanced by heating.

The liquid ink component (a solvent or a dispersion medium) that has been received and retained in the ink receiving particle layer 16A remains in the ink receiving particle layer 16A even after the transfer and fixing, and is then removed by air drying.

The image forming process is completed through the above processes. After the ink receiving particles 16 have been transferred from the intermediate transfer member 12 to the recording medium 8, the cleaning aid particles 21 are supplied to residual ink receiving particles 16D remaining on the intermediate transfer member 12 by means of the supply roll 23A of the cleaning aid particle supply unit 23. For example, the cleaning aid particles 21 are supplied so as to cover the residual ink receiving particles 16D. Specifically, as described above, the cleaning aid particles 21 are controlled to a desired thickness by the clearance between the charging blade 23B and the supply roll 23A so that the supply amount of the cleaning aid particles 21 to be supplied is controlled. Alternatively, the supply amount may be controlled by the ratio of circumferential speeds of the supply roll 23A and the intermediate transfer member 12.

Thereafter, the ink receiving particles 16, to which the cleaning aid particles 21 have been supplied, are cleaned by the cleaner 24. Foreign substances such as paper powder that has been released from the recording medium 8 are also cleaned together with the residual ink receiving particles 16D.

A charge remover 29 may also be provided downstream of the cleaner 24. For example, by using a semiconductive or conductive roll as the charge remover 29, the surface of the intermediate transfer member 12 can be electrically neutralized by nipping the intermediate transfer member 12 in between the charge remover 29 and the driven roll 31 (grounded), and applying a voltage of about ±3 kV at about 500 Hz to the surface of the intermediate transfer member 12.

The charging voltage, the thickness of the particle layer, the fixing temperature and other various conditions for the device may be optimized, respectively, depending on the composition of the ink receiving particles 16 or the ink, the amount of the ink to be ejected, and the like.

<Constituent Elements>

Constituent elements for each step of the embodiment will be described in detail below.

<Intermediate Transfer Member>

The intermediate transfer member 12 on which the ink receiving particle layer is formed may be in the form of a belt as shown in the embodiment, or in the form of a cylinder (a drum). In order to supply and retain the ink receiving particles on the surface of the intermediate transfer member by electrostatic force, the outer surface of the intermediate transfer member needs to have semiconductive or insulating particle-retention properties. When the electrical properties of the surface of the intermediate transfer member is semiconductive, a material with a surface resistivity of $10^{10}$ Ω/square or more and $10^{14}$ Ω/square or less and a volume resistivity of $10^{9}$Ω·cm or more and $10^{13}$Ω·cm or less is used, and when the electrical properties of the surface of the intermediate transfer member is insulating, a material with a surface resistivity of $10^{14}$ Ω/square or more and a volume resistivity of $10^{13}$Ω·cm or more can be used.

When the intermediate transfer member is in the form of a belt, any material can be used for the base material, as long as the material is capable of belt rotation driving in an apparatus and has necessary mechanical strength, and when heat is applied for transfer and fixing, necessary heat resistance. Specifically, polyimide, polyamideimide, aramid resins, polyethylene terephthalate, polyester, polyethersulfone, stainless steel, or the like may be used.

When the intermediate transfer member is in the form of a drum, the base material may be aluminum, stainless steel or the like.

When the heating method is performed by electromagnetic induction in the fixing process with the transfer fixing unit (transfer fixing roll) 22, a heat generating layer may be formed on the intermediate transfer member 12 instead of on the transfer fixing unit (transfer fixing roll) 22. A metal capable of causing electromagnetic induction may be used for the heat generating layer, which may be selected from nickel, iron, copper, aluminum, chromium, and the like.

<Particle Supply Process>

The ink receiving particle layer 16A is then formed on the surface of the intermediate transfer member 12 on which the releasing layer 14A has been formed. In this process, known methods for supplying an electro-photographic toner onto a photoreceptor can be applied to the method for forming the ink receiving particle layer 16A. Specifically, charges are supplied in advance to the surface of the intermediate transfer member 12 by a common electro-photographic charging method (such as a method for charging with a charger 28). The ink receiving particles 16 may be charged by friction (a single- or two-component frictional charging method) to have a polarity opposite to the charges on the surface of the intermediate transfer member 12.

The ink receiving particles 16 held on the feed roll 18A form an electric field with the surface of the intermediate transfer member 12, and are transferred and supplied onto the intermediate transfer member 12 and held there by electrostatic force. In this process, the thickness of the ink receiving particle layer 16A may be controlled depending on the thickness of the image layer 16B formed as a part of the ink receiving particle layer 16A (depending on the amount of the ink to be ejected). In this process, the absolute value of the amount of the charge of the ink receiving particles 16 is preferably in the range of 5 μc/g or more and 50 μc/g or less.

In this process, the thickness of the ink receiving particle layer 16A is preferably 1 μm or more and 100 μm or less, more preferably 1 μm or more and 50 μm or less, and still more preferably 5 μm or more and 25 μm or less. The porosity of the ink receiving particle layer (i.e., the sum of the void ratio in the ink receiving particles and the void ratio in the ink receiving particles (trap structure)) is preferably 10% or more and 80% or less, more preferably 30% or more and 70% or less, and still more preferably 40% or more and 60% or less.

Here, a particle supply process corresponding to a single-component supply (development) method will be described.

The ink receiving particles 16 are supplied to the feed roll 18A, then charged and the thickness thereof is regulated by the charging blade 18B.

The charging blade 18B has a function to regulate the thickness of the layer of the ink receiving particles 16 formed on the surface of the feed roll 18A. For example, the charging blade 18B can change the layer thickness of the ink receiving particles 16 on the surface of the feed roll 18A by changing the pressure applied to the feed roll 18A. For example, by forming a single layer of the ink receiving particles 16 on the surface of the feed roll 18A, the layer of the ink receiving particles 16 on the surface of the intermediate transfer member 12 may be made in the form of a single layer. Alternatively, by setting the pressing force of the charging blade 18B to a low level, the thickness of the layer of the ink receiving particles 16 formed on the surface of the feed roll 18A can be increased, and thus the thickness of the ink receiving particle layer formed on the surface of the intermediate transfer member 12 can be increased.

A method can also be mentioned in which, for example, when the peripheral speeds of the feed roll 18A and the intermediate transfer member 12 are defined as 1 respectively, at which a single particle layer is formed on the surface of the intermediate transfer member 12, the thickness of the layer of the ink receiving particles 16 can be increased by increasing the peripheral speed of the feed roll 18A to increase the amount of the ink receiving particles 16 supplied onto the surface of the intermediate transfer member 12.

By controlling the thickness of the ink receiving particle layer in such a manner, a pattern having a protective layer coating the surface of the pattern can be formed with reduced consumption of ink receiving particles.

The charging roll in the charger 28 may be a bar- or pipe-shaped member made of aluminum, stainless steel or the like having an elastic layer formed on the outer surface thereof, the elastic layer containing a conductivity-imparting material dispersed therein, and the roll having a diameter of 10 mm or more and 25 mm or less and a volume resistivity that is controlled to be about $10^{6}$Ω·cm or more and about $10^{8}$Ω·cm or less.

The elastic layer can be formed using urethane resins, thermoplastic elastomers, epichlorohydrin rubbers, ethylene-propylene-diene copolymer rubbers, silicone rubbers, acrylonitrile-butadiene copolymer rubbers, polynorbornene rubbers, and any other resin materials. These materials may be used alone or in combination of two or more, and a urethane foam resin is preferably used.

In a preferred mode, the urethane foam resin is a urethane resin containing a hollow material such as hollow glass beads and thermally expandable microcapsules mixed and dispersed therein to have a closed-cell structure.

The surface of the elastic layer may be covered with a water-repellant coating layer with a thickness of 5 μm or more and 100 μm or less.

The charger 28 is connected to a DC power source, and the driven roll 31 is electrically connected to the frame ground. The charger 28 is driven while holding the intermediate transfer member 12 between the charger 28 and the driven roll 31, and a predetermined potential difference is generated between the charger 28 and the grounded driven roll 31 at the pressing site.

<Marking Process>

An image is formed by ejecting the ink droplets 20A from the inkjet recording head 20 onto the layer of the ink receiving particles 16 (ink receiving particle layer 16A) which has been formed on the surface of the intermediate transfer member 12, according to an image signal. The ink droplets 20A are ejected into the ink receiving particle layer 16A from the inkjet recording head 20, and are rapidly absorbed into the interparticle voids formed in the ink receiving particles 16, while the recording material (such as a pigment) is trapped on the surface of the ink receiving particles 16 or in the interparticle voids of the ink receiving particles 16.

In this case, it is preferred that a large amount of the recording material (such as a pigment) is trapped on the surface of the ink receiving particle layer 16A. The interparticle voids in the ink receiving particles 16 exhibit a filter effect so that the recording material (such as a pigment) is trapped on the surface of the ink receiving particle layer 16A, and is trapped and fixed in the interparticle voids in the ink receiving particles 16.

In order to ensure the trapping of the recording material (such as a pigment) on the surface of the ink receiving particle layer 16A and in the interparticle voids in the ink receiving particles 16, a method may be applied in which the ink is allowed to react with the ink receiving particles 16 to rapidly insolubilize (aggregate) the recording material (such as a pigment). Specifically, a reaction between the ink and a polyvalent metal salt or a pH reaction type may be applied to the above reaction.

The inkjet recording head is preferably a line-type inkjet recording head having a width equal to or larger than the width of the recording medium. However, an image may also be formed on a particle layer formed on an intermediate transfer member in a sequential manner using a conventional scanning-type inkjet recording head. The means for ejecting ink of the inkjet recording head 20 may be any one as long as it is capable of ejecting ink, such as a piezoelectric element-driving type or a heating element-driving type. Conventional inks containing a dye as a colorant may be used for the ink, but an ink containing a pigment is preferable.

When reacting the ink receiving particles 16 with an ink, the ink receiving particles 16 is treated with an aqueous solution containing a coagulant (for example, a polyvalent metal salt or an organic salt) having an effect of coagulating a pigment by the reaction of the coagulant with the ink, and dried.

<Transfer Process>

The ink receiving particle layer 16A having received the ink droplets 20A and having been formed with an image is transferred and fixed onto the recording medium 8 so that the image is formed on the recording medium 8. The transfer and the fixing may be performed separately, but are preferably performed substantially simultaneously. The fixing may be performed by a method of heating the ink receiving particle layer 16A or a method of pressing it, or a method including both heating and pressing, but is preferably a method of performing heating and pressing substantially simultaneously.

By controlling the heating and pressing, physical properties and glossiness at the surface of the ink receiving particle layer 16A can be controlled. After the heating and pressing, the recording medium 8 having the image (ink receiving particle layer 16A) transferred thereon may be separated from the intermediate transfer member 12 after cooling the ink receiving particle layer 16A. The cooling may be performed by natural cooling or forced cooling such as air cooling. For these processes, the intermediate transfer member 12 is preferably in the form of a belt.

The ink image is preferably formed on a surface part of the layer of the ink receiving particles 16 formed on the intermediate transfer member 12 (the recording material (pigment) is trapped on the surface of the ink receiving particle layer 16A) so that the ink image is protected by the particle layer 16C of the ink receiving particles 16, when transferred onto the recording medium 8.

The liquid ink component (a solvent or a dispersion medium) that has been received and retained by the layer of the ink receiving particles 16 is maintained in the layer of the ink receiving particles 16 even after the transfer and the fixing, and is then removed by air drying.

<Releasing Layer>

Prior to supplying the ink receiving particles 16, the releasing layer 14A is formed with the releasing agent 14D supplied from the releasing agent supply unit 14 on the surface of the intermediate transfer member 12.

The releasing layer 14A may be formed by a method including feeding the releasing agent 14D, from a releasing agent supply unit that stores the releasing agent 14D, to the surface of the intermediate transfer member 12 to form the releasing layer 14A, or by a method including forming the releasing layer 14A on the surface of the intermediate transfer member 12 using a supplying member that has been impregnated with the releasing agent 14D.

<Cleaning Process>

In order to enable repeated use of the intermediate transfer member 12 by refreshing the surface thereof, a cleaning process for cleaning the surface by a cleaner 24 is required. Prior to the cleaning by the cleaner 24, the cleaning aid particles 21 are supplied from the cleaning aid supply unit 23 to ink receiving particles 16D remaining after a transfer process.

Here, the cleaning aid particles 21 enhance the cleaning ability (removing ability) of the cleaner 24 for the residual ink receiving particles 16D. Specifically, for example, the cleaning aid particles 21 enhance the cleaning ability (removing ability) of the cleaner 24 by drying the surface of the ink receiving particles 16D remaining on the intermediate transfer member 12, or reducing or eliminating the adhesiveness of the ink receiving particles 16D, after the transfer process (after transfer and fixing processes).

As the cleaning aid particles 21, hydrophobic particles or liquid absorbing particles can be mentioned. The hydrophobic particles dry the surface of the residual ink receiving particles 16D by covering (attaching to) the surface of the residual ink receiving particles 16D. On the other hand, the liquid absorbing particles absorb liquid components contained in the residual ink receiving particles 16D by attaching to the surface of the residual ink receiving particles 16D, thereby reducing or eliminating the adhesiveness of the residual ink receiving particles 16D to the liquid components contained therein. By using these hydrophobic particles or liquid absorbing particles as the cleaning particles 21, the cleaning ability can be effectively enhanced.

Figure 4B:
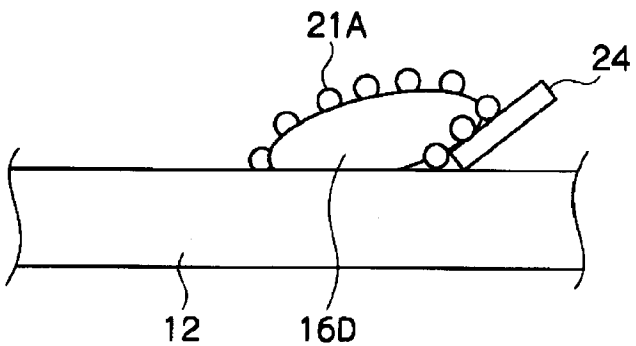
FIGS. 4A and 4B are schematic drawings illustrating functions in the case that hydrophobic particles are used as cleaning aid particles, respectively.
Figure 4A:
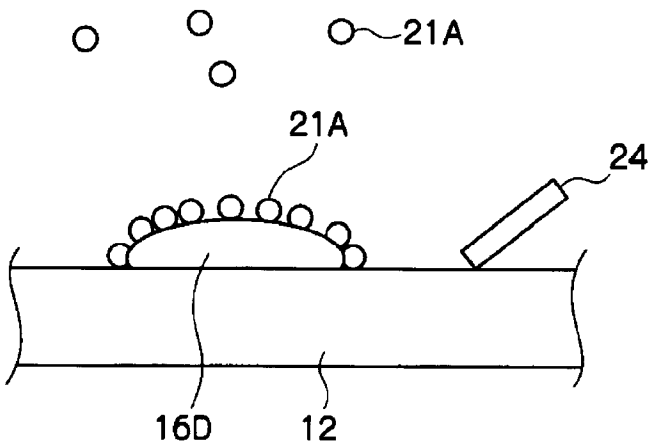

That is, when hydrophobic particles are used as the cleaning aid particles 21, as shown in FIG. 4A, the hydrophobic particles 21A are supplied to the residual ink receiving particles 16D to attach to the surface of the residual ink receiving particles 16D, and as shown in FIG. 4B, the residual ink receiving particles 16D are cleaned by the cleaner 24 (cleaning section) in a state that the surface of the residual ink receiving particles 16D is covered with the hydrophobic particles 21A, namely, in a dried state.

Figure 5B:
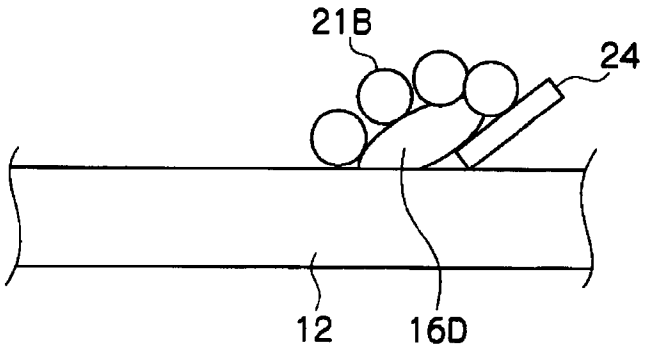
FIGS. 5A and 5B are schematic drawings illustrating functions in the case that water absorbing particles are used as cleaning aid particles, respectively.
Figure 5A:
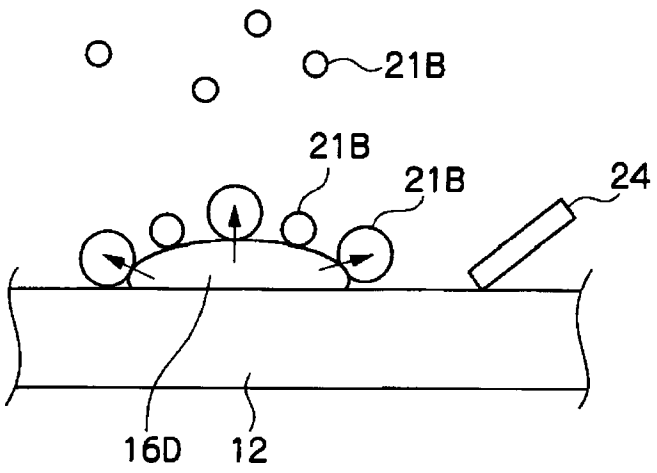

Meanwhile, when liquid absorbing particles are used as the cleaning aid particles 21, as shown in FIG. 5A, the liquid absorbing particles 21B are supplied to the residual ink receiving particles 16D to attach to the surface of the residual ink receiving particles 16D and absorb excessive water therefrom, and as shown in FIG. 5B, the residual ink receiving particles 16D are cleaned by the cleaner 24 (cleaning section) in a state that the surface of the residual ink receiving particles 16D is covered with the liquid absorbing particles 21B, namely, in a state that excessive water in the residual ink receiving particles 16D is absorbed by the liquid absorbing particles 21B to reduce or eliminate the adhesiveness of the residual ink receiving particles 16D.

As the hydrophobic particles, in light of facilitating drying the surface of the ink receiving particles by attaching to the ink receiving particles, for example, hydrophobic particles, polyvinylidene fluoride particles, tetrafluoroethylene particles (TEFLON (registered trademark) particles), aliphatic acid derivative particles, inorganic oxide particles and the like are preferably mentioned. The hydrophobic resin particles include, for example, acrylic resin particles, polystyrene resin particles, melamine resin particles and the like. The aliphatic acid derivative particles include zinc stearate, stearic acid amide, and the like. The inorganic oxide particles include cerium oxide particles, silica particles, alumina particles, and the like.

Further, the hydrophobic resin particles contain a hydrophobic resin at such an amount that the ratio of polar monomers to the total monomer components is in the range of from 0% by mole or about 0% by mole to 10% by mole or about 10% by mole, preferably in the range of from 0.1% by mole or about 0.1% by mole to 8% by mole or about 8% by mole, and further preferably in the range of from 2% by mole or about 2% by mole to 5% by mole or about 5% by mole.

The hydrophobic resins include a polymer of a single kind of hydrophobic monomer or a copolymer of two or more kinds of hydrophobic monomers. The hydrophobic monomers include olefin compounds such as ethylene, propylene, butadiene and the like, styrene derivatives such as styrene, α-methyl styrene, α-ethyl styrene, vinyl toluene and the like, methyl methacrylate, ethyl methacrylate, butyl methacrylate, acrylonitrile, vinyl acetate, methyl acrylate, ethyl acrylate, butyl acrylate, lauryl methacrylate, vinyl cyclohexane, vinyl naphthalene, vinyl naphthalene derivatives, alkyl acrylates, phenyl acrylates, alkyl methacrylates, phenyl methacrylates, cycloalkyl methacrylates, alkyl crotonates, dialkyl itaconates, dialkyl maleates, and the like.

The hydrophobic resins include preferably, for example, vinyl based resins (for example, such as styrene-(meth) acrylic acid copolymers, alkyl(meth)acrylate-(meth)acrylic acid copolymers and the like), polyester resins (for example, polyethylene terephthalate, polybutylene terephthalate and the like), silicone resins (for example, organopolysiloxanes and the like), fluorine based resins (for example, vinylidene fluoride resins, polytetrafluoroethylene, tetrafluoroethylene-perfluoroalkylvinyl copolymers, tetrafluoroethylene-ethylene copolymers and the like).

The hydrophobic resins mean resins having a liquid absorptivity of absorbing a liquid, for example, water in an amount of less than about 5% by mass with respect to the resin.

The aforementioned hydrophobic resins are used by controlling the ratio of polar monomers to the above range, regardless of the forms thereof.

Commercially available hydrophobic particle products include, for example:

acrylic particles such as MP SERIES Products manufactured by Soken Chemicals & Engineering Co., Ltd., TECHPOLYMER LMX manufactured by Sekisui Plastics Co., Ltd., TECHPOLYMER MBX manufactured by Sekisui Plastics Co., Ltd., EPOSTER MA manufactured by Nippon Shokubai Co., Ltd., and AR650S manufactured by Toyobo Co., Ltd.;

polystyrene particles such as SX SERIES Products manufactured by Soken Chemicals & Engineering Co., and TECHPOLYMER SBX manufactured by Sekisui Plastics Co., Ltd.;

melamine-formaldehyde resins such as EPOSTER manufactured by Nippon Shokubai Co., Ltd.;

zinc stearate particles such as SZ SERIES Products manufactured by Sakai Chemical Industry Co., Ltd.;

polyvinylidene fluoride particles such as KF #850/#1100/#2300 manufactured by Kureha Corporation, and KYNAR manufactured by MSI/Tokyo Zairyo; and tetrafluoroethylene particles such as TEFLON (registered trademark) particles, TEFLON (registered trademark) 7A manufactured by DuPont-Mitsui Polychemicals Co., Ltd., and SANPLA PTFE particles manufactured by Sanplatec Corporation.

On the other hand, the liquid absorbing particles contain at least organic resins in the range of from 30% by mole or about 30% by mole to 100% by mole or about 100% by mole, preferably in the range of from 50% by mole or about 50% by mole to 100% by mole or about 100% by mole, further preferably in the range of from 60% by mole or about 60% by mole to 100% by mole or about 100% by mole, in terms of the ratio of polar monomers to the total monomer components. Liquid components in the ink receiving particles can be effectively absorbed when the ratio of polar monomers in the organic resins is in the above range.

The composition of the organic resin that constitutes the liquid absorbing particles may be, for example, similar to that of the organic resin for the ink receiving particles, which will be described hereinafter. However, liquid absorbing particles as the cleaning aid particles 21 are preferably those that do not express adhesiveness and are non-adhesive even when a liquid is absorbed in the particles. As the composition of such liquid absorbing particles, resins having a high liquid absorptivity can be mentioned. Specific examples of such resins include starch based compounds such as acrylic acid-grafted starch, carboxymethylated starch and the like, cellulose compounds such as carboxymethyl cellulose and the like, anionic polymers such as polyacrylic acid, isobutylene maleic acid copolymers, polyaspartic acid and the like, nonionic polymers such as polyethylene glycol, pyrovinyl alcohol, polyacrylamide, cyclodextrin and the like, and cationic polymers such as polyethylene imine, polyvinyl pyridine and the like.

The sphere equivalent average particle diameter of the cleaning aid particles 21 is preferably in the range of from 0.05 μm or about 0.05 μm to 5 μm or about 5 μm, more preferably from 0.1 μm or about 0.1 μm to 5 μm or about 5 μm, further more preferably from 0.5 μm or about 0.5 μm to 5 μm or about 5 μm. When the particle diameter is in the above ranges, the cleaning aid particles tend to adhere to the ink receiving particles easily, and the cleaning performance for cleaning the ink receiving particles 16D remaining on the intermediate transfer member can further be improved.

Here, the sphere equivalent average particle diameter is determined in the following manner. Although the optimal methods are different depending on particle sizes, for example, a variety of methods can be utilized such as a Microtrac UPA method in which particles are dispersed in a liquid and the particle diameter is determined based on the light scattering principle, the coulter counter method in which particles are dispersed in a liquid and the particle diameter is determined based on an electric resistance method, and a method in which the particle diameter is determined by image-processing of projection images of the particles. As a commonly applicable method, a method in which 0.5 g of particles is dispersed in 50 g of ion exchange water and the particle diameter is measured by a Microtrac UPA can be mentioned.

The supply amount of the cleaning aid particles 21 is preferably in the range of from 0.01% or about 0.01% to 5% or about 5%, more preferably from 0.1% or about 0.1% to 5% or about 5%, further more preferably from 0.2% or about 0.2% to 1% or about 1%, in terms of the ratio (weight ratio) of the cleaning aid particles to the residual ink receiving particles 16D. By adjusting the supply amount to the above ranges, the cleaning performance for cleaning the ink receiving particles 16D remaining on the intermediate transfer member 12 can further be improved.

The cleaning aid particles 21 may be used singly, or two or kinds of particles may be used in combination. When two or more kinds of particles are used in combination, they may be mixed together, or one of those may be externally added or attached to another kind of particles.

The cleaning device 24 for cleaning the ink receiving particles 16D to which the above cleaning aid particles 21 are supplied (attached), is composed of a cleaning section and a particle transport and recovery section (not shown). A doctor method is preferably used in the cleaning section, but is not limited thereto.

<Charge Removing Process>

The surface of the intermediate transfer member 12 may be subjected to charge removing using the charge remover 29 prior to forming the releasing layer 14A.

In the recording device according to this embodiment described above, the surface of the intermediate transfer member 12 is charged by the charger 28 after supplying the releasing agent 14D from the releasing agent supply unit 14 to the surface of the intermediate transfer member 12 to form the releasing layer 14A. The ink receiving particles 16 are then supplied from the particle supply unit 18 to the region where the releasing layer 14A has been formed and charged of the intermediate transfer member 12, thereby forming a particle layer. Thereafter, ink droplets are ejected from the inkjet recording head 20 onto the particle layer to form an image, and the ink is received by the ink receiving particles 16. The recording medium 8 is then superposed onto the intermediate transfer member 12, pressed and heated by the transfer fixing unit 22, and thus the ink receiving particle layer is transferred and fixed onto the recording medium 8.

After the transferring (after the transferring and fixing), the cleaning aid particles 21 are supplied to the ink receiving particles 16D remaining on the intermediate transfer member 12 by means of a cleaning aid supply unit 23. Here, the residual ink receiving particles 16D develop adhesiveness due to liquid components in the ink, and is difficult to be cleaned in this state. For this reason, by supplying the cleaning aid particles 21 (for example, hydrophobic particles or liquid absorbing particles) to the residual ink receiving particles 16D, for example, the circumference of the residual ink receiving particles is made to a dry state, or the adhesiveness of the particles is reduced or eliminated by having the excessive liquid components absorbed by the cleaning aid particles 21. Under this condition, the cleaning is carried out by the cleaner 24. As a result, the cleaning performance for the residual ink receiving particles 16D remaining on the intermediate transfer member 12 can be improved, and occurrence of image defects (ghosting) due to such residual particles can be suppressed.

<Ink Receiving Particles>

Details of the ink receiving particles preferable used in the above embodiments will be described below. In this section, numerals shown in the drawings are not described.

The ink receiving particles of the invention receive an ink component when contacted with the ink. The "ink receiving property" here means the ability to retain at least part of the ink component (at least a liquid component). The ink receiving particles of the invention include, for example, an organic resin containing a polar monomer in an amount of from 10 mol % to 100 mol % with respect to the total amount of the monomers. Specifically, the ink receiving particles are, for example, the particles containing the above-mentioned organic resins (hereinafter, referred to as "hydrophilic organic particles"). In the following, the particles including such hydrophilic organic particles are referred to as "matrix particles".

Here, the description "the ink receiving particles are hydrophilic" means that the particles include at least an organic resin containing a polar monomer in an amount of from 10 mol % to 100 mol % with respect to the total amount of the monomers. Ink receiving particles having the above characteristic exhibit high adhesiveness relative to hydrophobic particles.

The matrix particle of the ink receiving particles may be in the form of a single hydrophilic organic particle (primary particle), or may be in the form of a composite particle of aggregated hydrophilic organic particles.

When the matrix particles are composed only of hydrophilic organic particles (primary particles), the ink receiving particles receive the ink in such a manner that the hydrophilic organic particles absorb at least a liquid component of the ink attaching to the ink receiving particles.

The ink receiving particles that have received the ink are then transferred onto the recording medium, and recording is carried out.

On the other hand, when the matrix particles are composite particles composed of aggregated hydrophilic organic particles, the ink receiving particles receive the ink in such a manner that voids among the particles that constitute the ink receiving particles (at least the hydrophilic organic particles) trap a liquid component of the ink (hereinafter, such interparticle voids are referred to as "trapping structure" sometimes). At this time, the recording material in the ink components is attached to the surface of the ink receiving particles or is trapped in the trapping structure. The ink receiving particles that have received the ink are then transferred onto the recording medium, and recording is carried out.

The trapping of the ink liquid components by this trapping structure is a physical and/or chemical action of the voids among the particles (physical particle wall structure).

By employing the matrix particles in the form of composite particles at least composed of aggregated hydrophilic organic particles, the hydrophilic organic particles themselves also serve to absorb and retain the ink liquid component, in addition to the trapping by the voids among the particles composing the composite particles (physical particle wall structure).

Further, after transferring the ink receiving particles, the component in the hydrophilic organic particles composing the ink receiving particles also functions as a binder resin or a coating resin for a recording material contained in the ink. Moreover, when the ink receiving particles are in the form of composite particles, the recording material is trapped in the trapping structure of the composite particles. It is particularly preferable that a transparent resin is used as the component in the hydrophilic organic particles composing the ink receiving particles.

In order to improve the fixability (wear resistance) of an ink using an insoluble component or a dispersed particulate substance such as a pigment as a recording material (e.g., a pigment ink), a large amount of resin to be added is required. However, when a large amount of polymer is added in the ink (including the treating liquid thereof), reliability of the ink ejecting unit may be impaired (for example, causing nozzle clogging). On the other hand, in the above constitution, the organic resin component composing the ink receiving particles may also serve as the above resin.

Here, the "voids among the particles composing the composite particles", i.e., the "trap structure" represents a physical particle wall structure at least capable of retaining a liquid component. The maximum opening size of the voids is preferably from 0.1 μm to 5 μm, and more preferably from 0.3 μm to 1 μm. In particular, the maximum size of the voids is preferably large enough to trap a recording material, especially a pigment having a volume average particle diameter of 100 nm, for example. Microscopic voids having the maximum opening size of less than 50 nm may also exist. It is preferable that the voids or capillary tubes are in communication with each other in the particles.

The size of the voids can be determined by reading a scanning electron microscope (SEM) image of the particle surface in an image analyzer, detecting the voids by binary coding process, then analyzing the size and distribution of the voids.

It is desirable that a recording material is also trapped together with a liquid component in the trapping structure. When the recording material, a pigment in particular, is trapped together with the ink liquid component in the trapping structure, the recording material can be retained and fixed within the ink receiving particles without being unevenly distributed. The ink liquid component here is mainly composed of an ink solvent or a dispersant (vehicle liquid).

The ink receiving particles of the invention will be described in more detail. As described above, the matrix particles of the ink receiving particles may be in the form of a single hydrophilic organic particle (primary particle) or may be in the form of a composite particle composed of at least aggregated hydrophilic organic particles. Particles other than the hydrophilic organic particles such as inorganic particles or porous particles may also constitute the composite particles. The matrix particles may be, of course, composed only of hydrophilic organic particles. Other particles than hydrophobic organic particles, such as inorganic particles, may also be used as the particles for attaching to the surface of the matrix particles.

Figure 6:
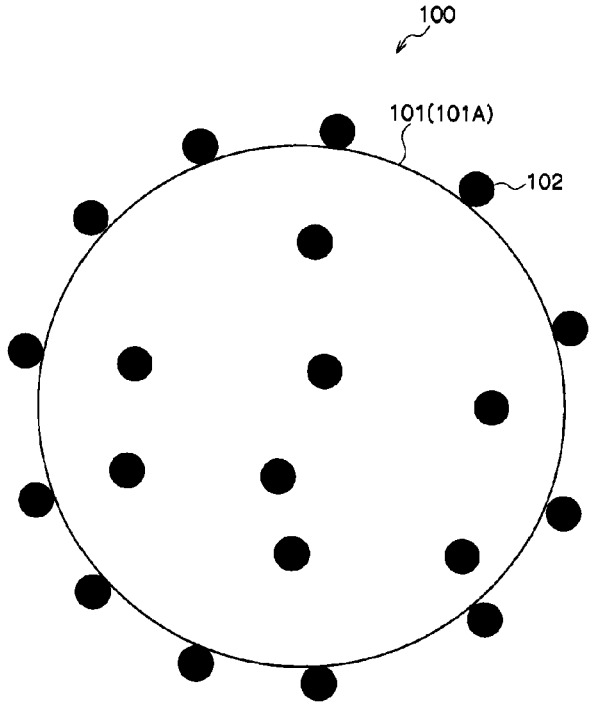
FIG. 6 is a conceptual drawing showing an exemplary embodiment of an ink receiving particle of the invention.
Figure 7:
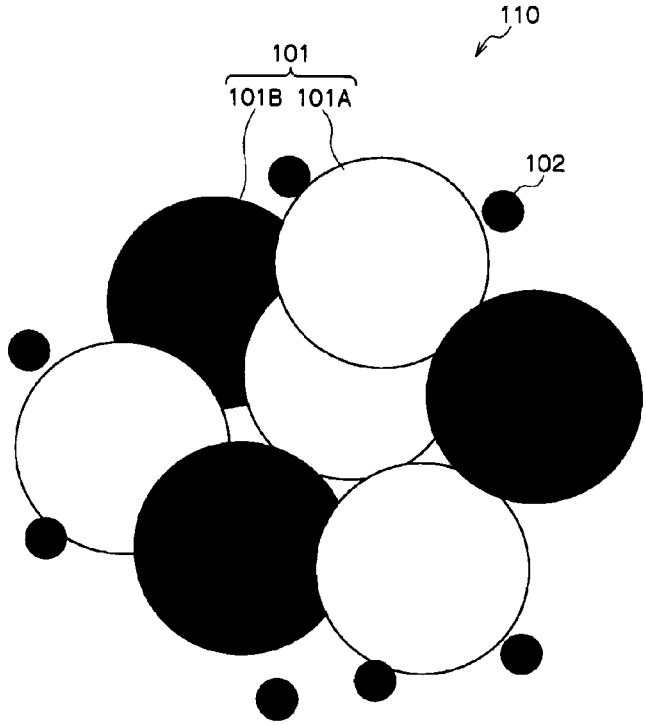
FIG. 7 is a conceptual drawing showing another exemplary embodiment of ink receiving particles of the invention.

As a specific structure of the ink receiving particle, as shown in FIG. 6, a structure can be mentioned in which the ink receiving particle 100 is composed of a single particle of hydrophilic organic resin particle 101A (primary particle), that constitutes matrix particle 101, and inorganic particles 102 attached to the matrix particle 101. Another exemplary structure may be, as shown in FIG. 7, a structure in which an ink receiving particle 110 is composed of a matrix particle 101 in the form of a composite of hydrophilic organic particles 101A and inorganic particles 101B, and inorganic particles 102 attached to the matrix particle 101. In the matrix particles in the form of a composite, a void structure can be created by the voids among the constituent particles.

The ratio by weight of the hydrophilic organic particles and other particles (hydrophilic organic particles:other particles) may be, for example, in the range of 5:1 to 1:10, when the other particles are inorganic particles.

The volume average particle size of the matrix particles is preferably from 0.1 μm to 50 μm, more preferably from 0.5 μm to 25 μm, and still more preferably 1 μm to 10 μm.

The BET specific surface area ($N_2$) of the matrix particle in the form of a composite is, for example, in the range of 1 $m^2/g$ to 750 $m^2/g$.

The composite particles composing the matrix particles may be obtained by granulating the particles in a semi-sintered state. Being in a semi-sintered state means that the shape of the particles remains to a certain degree and the voids among the particles are maintained. When the ink liquid component is trapped in the trapping structure, the composite particles may be partly dissociated, i.e., the composite particles may be decomposed to disperse the constituent particles.

The hydrophilic organic particles will now be described. The hydrophilic organic particles contain, for example, a polar monomer in the ratio of from 10 mol % to 100 mol % with respect to the total component of the monomer, preferably from 15 mol % to 85 mol %, and further preferably contain an organic resin of from 20 mol % to 60 mol %. Specifically, the hydrophilic organic particles preferably contain an organic resin composed of a polar monomer in the ratio of the above range.

Here, the polar monomer represents a monomer containing an ethylene oxide group, carboxylic acid group, sulfonic acid group, substituted or non-substituted amino group, hydroxyl group, or a salt thereof. For example, in the case of imparting a positive charge, the monomer preferably has a salt forming structure of (substituted) amino group, (substituted) pyridine group or an amine salt thereof, quaternary ammonium salt and the like. In the case of imparting a negative charge, the monomer is preferably an organic acid (salt) structure of carboxylic acid (salt), sulfonic acid (salt), and the like.

The ratio of the polar monomer can be determined by identifying the structure of the organic component according to analytical methods such as mass spectrometry, NMR or IR; measuring the acid value and base value of the organic component in accordance with JIS K0070 or JIS K2501; and then calculating the ratio of the polar monomer from the structure and the acid/base values of the organic component (hereinafter, the same shall apply).

The hydrophilic organic particles are, for example, composed of a liquid absorbing resin. The ink liquid component (such as water or an aqueous solvent) that has been absorbed in the resin serves as a plasticizer, and can soften the resin (polymer) and contribute to fixability.

The liquid absorbing resin is preferably a weak liquid absorbing resin. The weak liquid absorbing resin represents a lyophilic resin capable of absorbing a liquid in the range of from several percents (approximately 5%) to several hundreds of percents (approximately 500%), preferably from about 5% to about 100%, relative to a resin by weight, when water is absorbed as a liquid.

The liquid absorbing resin may be composed of either a homopolymer of a hydrophilic monomer or a copolymer of a hydrophilic monomer and a hydrophobic monomer, but is preferably a copolymer in order to obtain a weak liquid absorbing resin. The resin may also be a graft copolymer or a block copolymer obtained by copolymerizing a starting unit having a structure of polymer, oligomer or the like with other units.

Examples of the hydrophilic monomers include monomers having a group such as —OH, -EO unit (ethylene oxide group), —COOM (M is a hydrogen, an alkali metal such as Na, Li, K, ammonia, organic amines, or the like), —$SO_3M$ (M is a hydrogen, alkali metal such as Na, Li, K, ammonia, organic amines, or the like.), —$NR_3$ (R is H, alkyl, phenyl or the like), and —$NR_4X$ (R is H, alkyl, phenyl or the like, and X is a halogen, a sulfate radical, acidic anions such as a carboxylic acid, $BF_4$, or the like). Specific examples of the hydrophilic monomer include 2-hydroxy ethyl methacrylate, 2-hydroxy ethyl acrylate, acrylamide, acrylic acid, methacrylic acid, unsaturated carboxylic acid, crotonic acid, and maleic acid. Examples of a hydrophilic unit or monomer include cellulose derivatives such as cellulose, ethyl cellulose, carboxy methyl cellulose; starch derivatives, derivatives of monosaccharides and polysaccharides, vinyl sulfonic acid, styrene sulfonic acid, polymerizable carboxylic acids such as acrylic acid, methacrylic acid and (anhydrous) maleic acid, and (partially) neutralized salts thereof, vinyl alcohols; derivatives such as vinyl pyrrolidone, vinyl pyridine, amino (meth)acrylate or dimethyl amino (meth)acrylate, or onium salts thereof, amides such as acrylamide or isopropyl acrylamide; vinyl compounds containing a polyethylene oxide chain; vinyl compounds containing a hydroxyl group; polyesters composed of a polyfunctional carboxylic acid and a polyhydric alcohol, especially branched polyesters having three or more acids and plural carboxylic acids or hydroxyl groups at the end portion such as trimellitic acid, or polyesters having a polyethylene glycol structure, and the like.

Examples of the hydrophobic monomers include monomers a having hydrophobic group, and specific examples thereof include olefins (ethylene, butadiene and the like), styrene, alpha-methyl styrene, alpha-ethyl styrene, methyl methacrylate, ethyl methacrylate, butyl methacrylate, acrylonitrile, vinyl acetate, methyl acrylate, ethyl acrylate, butyl acrylate, lauryl methacrylate, and the like. Examples of the hydrophobic units or monomers include styrene derivatives such as styrene, alpha-methyl styrene, vinyl toluene; vinyl cyclohexane, vinyl naphthalene, vinyl naphthalene derivatives, alkyl acrylate, phenyl acrylate, alkyl methacrylate, phenyl methacrylate, cycloalkyl methacrylate, alkyl crotonate, dialkyl itaconate, dialkyl maleate, and derivatives thereof.

Specific examples of the liquid absorbing resins composed of copolymers of the above hydrophilic monomers and the hydrophobic monomers include (meth)acrylates, copolymers of styrene/(meth)acrylic acid/(anhydrous) maleic acid, olefin polymers of ethylene/propylene or the like (or modifications thereof or carboxylic acid unit-introduced products thereof obtained by copolymerization), branched polyesters having an acid value enhanced by a trimellitic acid or the like, polyesters, polyamides, and the like.

The liquid absorbing resin preferably includes a structure of neutralized salt (for example, a carboxylic acid). The neutralized salt structure such as a carboxylic acid forms an ionomer when the resin absorbs an ink containing a cation (for example, a monovalent metal cation such as Na and Li), by the interaction with the cation.

The liquid absorbing resin preferably contains a substituted or non-substituted amino group, or a substituted or non-substituted pyridine group. Such a group can provide a bactericidal effect or cause an interaction with a recording material having an anion group (for example, a pigment or a dye).

In the liquid absorbing resin, the molar ratio of the hydrophilic unit (hydrophilic monomer) and the hydrophobic unit (hydrophobic monomer), i.e., hydrophilic monomer:hydrophobic monomer, is preferably from 5:95 to 70:30.

The liquid absorbing resin may be ion-crosslinked by an ion supplied from the ink. Specifically, a unit having a carboxylic acid such as copolymers containing a carboxylic acid such as (meth)acrylic acid or maleic acid or a (branched) polyesters having a carboxylic acid can be included in the liquid absorbing resin. Ion crosslinking or acid-base interaction occurs between the carboxylic acid in the resin and the alkali metal cation, alkaline earth metal cation, or an organic amine/onium cation supplied from a liquid such as an aqueous ink.

Characteristics of the liquid absorbing resins will be described below.

The liquid absorbing resin may have a straight chain structure, but preferably has a branched structure. Further, the liquid absorbing resin is preferably non-crosslinked or low-crosslinked. The liquid absorbing resin may be a random copolymer or a block copolymer having a straight chain structure, but is more preferably a polymer having a branched structure (including a branched random copolymer, block copolymer and graft copolymer). For example, in the case of polyesters that are synthesized by polycondensation, the amount of the end groups can be increased in a branched structure. One of the common methods for producing such branched structure is adding a so-called crosslinking agent such as divinyl benzene or di(meth)acrylates at the time of synthesizing (with an addition amount of, for example, less than 1%) or adding a large amount of an initiator together with the crosslinking agent.

The liquid absorbing resin may further include a charge controlling agent for electrophographic toner, such as low molecular weight quaternary ammonium salts, organic borates, salt-forming compounds of a salicylic acid derivative, or the like. In order to control the conductivity, it is effective to add an inorganic material having conductivity (hereinafter, the term "conductivity" is defined, for example, as "a volume resistivity of $10^7\Omega\cdot$cm of less, unless otherwise specified), or having semiconductivity (hereinafter, the term "semiconductivity" is defined, for example, as "a volume resistivity of from $10^7\Omega\cdot$cm to $10^{13}$ $\Omega\cdot$cm, unless otherwise specified).

The organic resin is preferably an amorphous resin having a glass transition temperature (Tg) of, for example, from 40° C. to 90° C. The glass transition temperature (and the melting point) is determined from the major maximum peak measured in accordance with ASTMD 3418-8. The major maximum peak can be measured by using DSC-7 (manufactured by Perkin Elmer Japan Co., Ltd). In this apparatus, temperature of a detection unit is corrected according to the melting points of indium and zinc, and the calorimetric value is corrected according to the heat of fusion of indium. Measurement for a sample is carried out at an temperature elevated at a rate of 10° C./min using an aluminum pan, with an empty pan set for a control.

The weight-average molecular weight of the liquid absorbing resin is, for example, from 3,000 to 300,000. The weight-average molecular weight is measured under the following conditions: for example, HLC-8120GPC, SC-8020 (manufactured by TOSOH CORPORATION) is used as a GPC apparatus, two pieces of TSK gel, SuperHM-H (manufactured by TOSOH CORPORATION, 6.0 mm ID×15 cm) are used as columns, and THF (tetrahydrofuran) is used as an eluent. The experiment is carried out under the following conditions: the sample density of 0.5%, flow rate of 0.6 ml/min, sample injection amount of 10 μl, measuring temperature of 40° C., and using an IR detector. A calibration curve is prepared from ten samples of Polystyrene Standard Sample TSK Standard manufactured by TOSOH CORPORATION, A-500, F-1, F-10, F-80, F-380, A-2500, F-4, F-40, F-128 and F-700.

The acid value of the liquid absorbing resin may be, for example, from 50 mgKOH to 777 mgKOH, in terms of carboxylic acid group (—COOH). The acid value in terms of carboxylic acid group (—COOH) can be measured as follows.

The acid value can be measured by a neutralization titration method in accordance with JIS K 0070: a proper amount of the sample is mixed with 100 ml of a solvent (diethyl ether/ethanol mixture) with the addition of several droplets of an indicator (phenolphthalein solution). The resulting mixture is shaken in a water bath until the sample is completely dissolved. The solution is titrated with 0.1 mol/L of a potassium hydroxide ethanol solution, and the point at which a scarlet color of the indicator exhibits for 30 seconds is determined as the termination point. The acid value is then calculated by the following equation:

$$A=(B\times f\times 5.611)/S$$

In the above equation, A represents the acid value; S is the sample amount (g); B is the amount (ml) of 0.1 mol/L of potassium hydroxide ethanol solution used in titration; and f is a factor of 0.1 mol/L of potassium hydroxide ethanol solution.

The above-described liquid absorbing resins of any form contain the ratio of the polar monomer within the above-described range.

The particle diameter of the hydrophilic particle, when the primary particle thereof is a matrix particle, is from 0.1 μm to 50 μm, preferably from 0.5 μm to 25 μm, and more preferably from 1 μm to 10 μm, in terms of average particle diameter. On the other hand, when the hydrophilic particles are constituent particles of a composite particle, the particle diameter is from 10 nm to 30 μm, preferably from 50 nm to 10 μm, and more preferably from 0.1 μm to 5 μm, in terms of average particle diameter.

The ratio of the hydrophilic particles with respect to the total ink receiving particles is, for example, 75% by weight or more, preferably 85% by weight or more, and more preferably from 90% by weight to 99% by weight.

Details of the inorganic particles that form the composite particles together with the hydrophilic particles, or the inorganic particles attached to the matrix particles will now be explained. The inorganic particles may be porous or may not. Examples of the inorganic particles include colorless, pale color, or white particles of, for example, colloidal silica, alumina, calcium carbonate, zinc oxide, titanium oxide, tin oxide and the like. These inorganic particles may be subjected to a surface treatment (partially hydrophobilizing treatment, introduction of a specific functional group, etc.). In the case of silica, for example, a hydroxyl group in silica is treated with a silylating agent such as trimethyl chlorosilane or t-butyl dimethyl chlorosilane to introduce an alkyl group. Then, dehydrochlorination is caused by the silylating agent, and the reaction proceeds. In this process, the reaction can be promoted by adding an amine to convert the hydrochloric acid into hydrochloride. The reaction can be controlled by regulating the amount of a silane coupling agent having an alkyl group or phenyl group as a hydrophobic group, or a titanate- or zirconate-based coupling agent, or the conditions for the treatment. The surface treatment can also be carried out by using aliphatic alcohols, higher fatty acids or derivatives thereof. Further, the surface treatment can also be carried out by using a coupling agent having a cationic functional group such as a silane coupling agent having a (substituted) amino group or a quaternary ammonium salt structure, a coupling agent having a fluorine functional group such as fluorosilane, and other coupling agents having an anionic functional group such as a carboxylic acid. The inorganic particles may be included inside of the hydrophilic organic particles, i.e., internally added.

The particle diameter of the inorganic particles that constitutes the composite particle is, for example, from 10 nm to 30 μm, preferably from 50 nm to 10 μm, and more preferably from 0.1 μm to 5 μm, in terms of particle average diameter. On the other hand, the particle diameter of the inorganic particles to be attached to the matrix particle is, for example, from 10 nm to 1 μm, preferably from 10 nm to 0.1 μm, and more preferably from 10 nm to 0.05 μm, in terms of particle average diameter.

Next, details of the other additives for the ink receiving particles will be described. The ink receiving particles preferably contain a component that aggregates or thickens the ink component.

The component having the above functions may be contained in the form of a functional group in a resin constituting the above liquid absorbing resin, or in the form of a compound. Examples of such functional groups include a carboxylic acid, polyhydric metal cations, polyamines and the like.

Preferred examples of the above compound include aggregating agents such as inorganic electrolytes, organic acids, inorganic acids, organic amines and the like.

Examples of the inorganic electrolytes include a salt of an alkaline metal ion such as a lithium ion, a sodium ion, a potassium ion, or a polyvalent metal ion such as an aluminum ion, a barium ion, a calcium ion, a copper ion, an iron ion, a magnesium ion, a manganese ion, a nickel ion, a tin ion, a titanium ion and a zinc ion; and an inorganic acid such as hydrochloric acid, hydrobromic acid, hydriodic acid, sulfuric acid, nitric acid, phosphoric acid and thiocyanic acid, an organic carboxylic acid such as acetic acid, oxalic acid, lactic acid, fumaric acid, citric acid, salicylic acid and benzoic acid, or an organic sulfonic acid.

Specific examples of the above inorganic electrolytes include an alkaline metal salt such as lithium chloride, sodium chloride, potassium chloride, sodium bromide, potassium bromide, sodium iodide, potassium iodide, sodium sulfate, potassium nitrate, sodium acetate, potassium oxalate, sodium citrate, and potassium benzoate; and a polyvalent metal salt such as aluminum chloride, aluminum bromide, aluminum sulfate, aluminum nitrate, aluminum sodium sulfate, aluminum potassium sulfate, aluminum acetate, barium chloride, barium bromide, barium iodide, barium oxide, barium nitrate, barium thiocyanate, calcium chloride, calcium bromide, calcium iodide, calcium nitrite, calcium nitrate, calcium dihydrogen phosphate, calcium thiocyanate, calcium benzoate, calcium acetate, calcium salicylate, calcium tartrate, calcium lactate, calcium fumarate, calcium citrate, copper chloride, copper bromide, copper sulfate, copper nitrate, copper acetate, iron chloride, iron bromide, ion iodide, iron sulfate, iron nitrate, iron oxalate, iron lactate, iron fumarate, iron citrate, magnesium chloride, magnesium bromide, magnesium iodide, magnesium sulfate, magnesium nitrate, magnesium acetate, magnesium lactate, manganese chloride, manganese sulfate, manganese nitrate, manganese dihydrogen phosphate, manganese acetate, manganese salicylate, manganese benzoate, manganese lactate, nickel chloride, nickel bromide, nickel sulfate, nickel nitrate, nickel acetate, tin sulfate, titanium chloride, zinc chloride, zinc bromide, zinc sulfate, zinc nitrate, zinc thiocyanate, and zinc acetate.

Specific examples of the organic acids include arginine acid, citric acid, glycine, glutamic acid, succinic acid, tartaric acid, cysteine, oxalic acid, fumaric acid, phthalic acid, maleic acid, malonic acid, lycine, malic acid, and compounds represented by Formula (1) and derivatives thereof Formula (1)

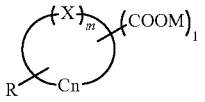

In the Formula (1), X represents O, CO, NH, $NR_1$, S or $SO_2$; R represents an alkyl group and is preferably $CH_3$, $C_2H_5$ and $C_2H_4OH$, wherein R may be included in the Formula or may not be included; X is preferably CO, NH, NR or O, and more preferably CO, NH or O; M represents a hydrogen atom, an alkali metal or an amine and is preferably H, Li, Na, K, monoethanol amine, diethanol amine, triethanol amine or the like, more preferably H, Na or K, and further preferably a hydrogen atom; n represents an integer of from 3 to 7 and is preferably an integer with which the heterocyclic ring is a six-membered or five-membered ring, and more preferably an integer with which the heterocyclic ring is a five-membered ring; and m represents 1 or 2. The compound represented by the Formula (1) may be a saturated ring or an unsaturated ring as long as the compound is in the form of a heterocyclic ring. 1 represents an integer of from 1 to 5.

Examples of the compounds represented by the Formula (1) include compounds having a structure of furan, pyrrole, pyrroline, pyrrolidone, pyrone, pyrrole, thiophene, indole, pyridine or quinoline, and further including a carboxyl group as a functional group. Specific examples of the compounds include 2-pyrrolidone-5-carboxylic acid, 4-methyl-4-pentanolide-3-carboxylic acid, furan carboxylic acid, 2-benzofuran carboxylic acid, 5-methyl-2-furan carboxylic acid, 2,5-dimethyl-3-furan carboxylic acid, 2,5-furan dicarboxylic acid, 4-butanolide-3-carboxylic acid, 3-hydroxy-4-pyrone-2,6-dicarboxylic acid, 2-pyrone-6-carboxylic acid, 4-pyrone-2-carboxylic acid, 5-hydroxy-4-pyrone-5-carboxylic acid, 4-pyrone-2,6-dicarboxylic acid, 3-hydroxy-4-pyrone-2,6-dicarboxylic acid, thiophene carboxylic acid, 2-pyrrole carboxylic acid, 2,3-dimethylpyrrole-4-carboxylic acid, 2,4,5-trimethylpyrrole-3-propionic acid, 3-hydroxy-2-indole carboxylic acid, 2,5-dioxo-4-methyl-3-pyrroline-3-propionic acid, 2-pyrrolidine carboxylic acid, 4-hydroxyproline, 1-methylpyrrolidine-2-carboxylic acid, 5-carboxy-1-methyl pyrrolidine-2-acetic acid, 2-pyridine carboxylic acid, 3-pyridine carboxylic acid, 4-pyridine carboxylic acid, pyridine dicarboxylic acid, pyridine tricarboxylic acid, pyridine pentacarboxylic acid, 1,2,5,6-tetrahydro-1-methyl nicotinic acid, 2-quinoline carboxylic acid, 4-quinoline carboxylic acid, 2-phenyl-4-quinoline carboxylic acid, 4-hydroxy-2-quinoline carboxylic acid, and 6-methoxy-4-quinoline carboxylic acid.

Preferable examples of the organic acids include citric acid, glycine, glutamic acid, succinic acid, tartaric acid, phthalic acid, pyrrolidone carboxylic acid, pyrone carboxylic acid, pyrrole carboxylic acid, furan carboxylic acid, pyridine carboxylic acid, coumaric acid, thiophene carboxylic acid, nicotinic acid, or derivatives or salts thereof. The organic acid is more preferably pyrrolidone carboxylic acid, pyrone carboxylic acid, pyrrole carboxylic acid, furan carboxylic acid, pyridine carboxylic acid, coumaric acid, thiophene carboxylic acid, nicotinic acid, or a derivative or salt thereof. The organic acid is further preferably pyrrolidone carboxylic acid, pyrone carboxylic acid, furan carboxylic acid, coumaric acid, or a derivative or salt thereof.

An organic amine compound may be any of a primary amine, secondary amine, tertiary amine, quaternary amine and a salt thereof. Specific examples of the organic amine compounds include a tetraalkyl ammonium, alkylamine, benzalconium, alkylpyridium, imidazolium, polyamine and a derivative or salt thereof, such as amyl amine, butyl amine, propanol amine, propyl amine, ethanol amine, ethyl ethanol amine, 2-ethyl hexyl amine, ethyl methyl amine, ethyl benzyl amine, ethylene diamine, octyl amine, oleyl amine, cyclooctyl amine, cyclobutyl amine, cyclopropyl amine, cyclohexyl amine, diisopropanol amine, diethanol amine, diethyl amine, di-2-ethylhexyl amine, diethylene triamine, diphenyl amine, dibutyl amine, dipropyl amine, dihexyl amine, dipentyl amine, 3-(dimethylamino)propyl amine, dimethyl ethyl amine, dimethyl ethylene diamine, dimethyl octyl amine, 1,3-dimethyl butyl amine, dimethyl-1,3-propane diamine, dimethyl hexyl amine, amino butanol, amino propanol, amino propane diol, N-acetyl amino ethanol, 2-(2-amino ethyl amino) ethanol, 2-amino-2-ethyl-1,3-propane diol, 2-(2-amino ethoxy)ethanol, 2-(3,4-dimethoxy phenyl)ethyl amine, cetyl amine, triisopropanol amine, triisopentyl amine, triethanol amine, trioctyl amine, trityl amine, bis(2-aminoethyl) 1,3-propane diamine, bis(3-aminopropyl)ethylene diamine, bis(3-aminopropyl)1,3-propane diamine, bis(3-amino propyl)methyl amine, bis(2-ethyl hexyl) amine, bis (trimethyl silyl) amine, butyl amine, butyl isopropyl amine, propane diamine, propyl diamine, hexyl amine, pentyl amine, 2-methyl cyclohexyl amine, methyl propyl amine, methyl benzyl amine, monoethanol amine, lauryl amine, nonyl amine, trimethyl amine, triethyl amine, dimethyl propyl amine, propylene diamine, hexamethylene diamine, tetraethylene pentamine, diethyl ethanol amine, tetramethyl ammonium chloride, tetraethyl ammonium bromide, dihydroxy ethyl stearyl amine, 2-heptadecenyl-hydroxyethyl imidazoline, lauryl dimethyl benzyl ammonium chloride, cetyl pyridinium chloride, stearamid methyl pyridium chloride, a diallyl dimethyl ammonium chloride polymer, a diallyl amine polymer, and a monoallyl amine polymer.

Among these organic amine compounds, triethanol amine, triisopropanol amine, 2-amino-2-ethyl-1,3-propanediol, ethanol amine, propane diamine, and propyl amine are more preferably used.

Among the above aggregating agents, polyvalent metal salts such as $Ca(NO_3)$, $Mg(NO_3)$, $Al(OH_3)$, a polyaluminum chloride and the like, are preferably used.

The aggregating agent may be used alone or in combination of two or more kinds thereof. The content of the aggregating agent is preferably from 0.01% by weight to 30% by weight, more preferably from 0.1% by weight to 15% by weight, and further preferably from 1% by weight to 15% by weight.

The ink receiving particles of the invention preferably contain a releasing agent. The releasing agent may be contained in the liquid absorbing resin, or may be included in the form of releasing agent particles by compounding with particles of liquid absorbing resin.

Examples of the releasing agents include low molecular polyolefins such as polyethylene, polypropylene and polybutene; silicones having a softening point by heating; fatty acid amides such as oleic amide, erucic amide, ricinoleic amide and stearic amide; vegetable waxes such as carnauba wax, rice wax, candelilla wax, Japan wax and jojoba oil; animal waxes such as beeswax; mineral or petroleum waxes such as montan wax, ozokerite, ceresin, paraffin wax, microcrystalline wax and Fischer-Tropsch wax; and modifications thereof. Among them, crystalline compounds are preferably used.

Hereinafter, details of the ink used in the above exemplary embodiment will be described. In the embodiment, a water-based ink is used. The water-based ink (hereinafter, simply referred to as an ink) may contain an ink solvent (for example, water or a water soluble organic solvent), in addition to a recording material. As required, other additives may be also contained in the ink.

Details of the recording material will now be explained. A colorant is mainly used as the recording material, which may be either a dye or a pigment, but is preferably a pigment. Either an organic pigment or an inorganic pigment can be used as the pigment. Examples of the black pigments include carbon black pigments such as furnace black, lamp black, acetylene black, and channel black. In addition to black and three primary colors of cyan, magenta and yellow, other pigments of specific colors such as red, green blue, brown or white, metal glossy pigments of gold, silver or the like, body pigments of colorless or pale color, plastic pigments, or the like. A pigment newly synthesized for the invention may also be used.

Further, particles composed of a core of silica, alumina, polymer bead or the like on which a dye or a pigment is fixed, an insoluble lake compound of a dye, a colored emulsion, a colored latex or the like can also be used as a pigment.

Specific examples of the black pigments used in the present invention include RAVEN 7000, RAVEN 5750, RAVEN 5250, RAVEN 5000 ULTRA II, RAVEN 3500, RAVEN 2000, RAVEN 1500, RAVEN 1250, RAVEN 1200, RAVEN 1190 ULTRA II, RAVEN 1170, RAVEN 1255, RAVEN 1080 and RAVEN 1060 (manufactured by Columbian Carbon Company); REGAL 400R, REGAL 330R, REGAL 660R, MOGUL L, Black Pearls L, MONARCH 700, MONARCH 800, MONARCH 880, MONARCH 900, MONARCH 1000, MONARCH 1100, MONARCH 1300 and MONARCH 1400 (manufactured by Cabot Corporation); Color Black FW1, Color Black FW2, Color Black FW2V, Color Black 18, Color Black FW200, Color Black S150, Color Black S160, Color Black S170, PRINTEX 35, PRINTEX U, PRINTEX V, PRINTEX 140U, PRINTEX 140V, Special Black 6, Special Black 5, Special Black 4A and Special Black 4 (manufactured by Degussa Co.); and No. 25, No. 33, No. 40, No. 47, No. 52, No. 900, No. 2300, MCF-88, MA 600, MA 7, MA 8 and MA 100 (manufactured by Mitsubishi Chemical Co., Ltd.). However, the pigments are not restricted thereto.

Specific examples of the cyan color pigments include C.I. Pigment Blue-1, -2, -3, -15, -15:1, -15:2, -15:3, -15:4, -16, -22 and -60, but are not restricted thereto.

Specific examples of the magenta color pigments include C.I. Pigment Red-5, -7, -12, -48, -48:1, -57, -112, -122, -123, -146, -168, -177, -184, -202, and C.I. Pigment Violet -19, but are not restricted thereto.

Specific examples of the yellow color pigments include C.I. Pigment Yellow-1, -2, -3, -12, -13, -14, -16, -17, -73, -74, -75, -83, -93, -95, -97, -98, -114, 128, -129, -138, -151, -154 and -180, but are not restricted thereto.

Here, in the case where a pigment is used as the colorant, it is preferable to use a pigment dispersing agent in combination. Examples of usable pigment dispersing agents include a polymer dispersing agent, an anionic surfactant, a cationic surfactant, an amphoteric surfactant and a nonionic surfactant.

As the polymer dispersing agent, a polymer having both of a hydrophilic structure part and a hydrophobic structure part are preferably used. As the polymer having a hydrophilic structure part and a hydrophobic structure part, a condensation-type polymer and an addition polymer can be used. Examples of the condensation-type polymers include known polyester-based dispersing agents. Examples of the addition polymers include addition polymers of monomers having an α,β-ethylenically unsaturated group. By copolymerizing a monomer having an α,β-ethylenically unsaturated group with a hydrophilic group and a monomer having an α,β-ethylenically unsaturated group with a hydrophobic group, a desired polymer dispersing agent can be obtained. Further, a homopolymer of monomers having an α,β-ethylenically unsaturated group with a hydrophilic group can also be used.

Examples of the monomers having an α,β-ethylenically unsaturated group with a hydrophilic group include monomers having a carboxyl group, a sulfonic acid group, a hydroxyl group, a phosphoric acid group or the like; specifically, acrylic acid, methacrylic acid, crotonic acid, itaconic acid, itaconic acid monoester, maleic acid, maleic acid monoester, fumaric acid, fumaric acid monoester, vinyl sulfonic acid, styrene sulfonic acid, sulfonated vinyl naphthalene, vinyl alcohol, acrylamide, methacryloxy ethyl phosphate, bis(methacryloxy ethyl) phosphate, methacryloxy ethyl phenyl acid phosphate, ethylene glycol dimethacrylate, diethylene glycol dimethacrylate and the like.

Examples of the monomer having an α,β-ethylenically unsaturated group with a hydrophobic group include styrene derivatives such as styrene, α-methylstyrene and vinyl toluene, vinyl cyclohexane, vinyl naphthalene, vinyl naphthalene derivatives, alkyl acrylate, alkyl methacrylate, phenyl methacrylate, cycloalkyl methacrylate, alkyl crotonate, dialkyl itaconate, dialkyl maleate and the like.

Preferable examples of the copolymers used as a polymer dispersant include a styrene-styrene sulfonic acid copolymer, a styrene-maleic acid copolymer, a styrene-methacrylic acid copolymer, a styrene-acrylic acid copolymer, a vinylnaphthalene-maleic acid copolymer, a vinylnaphthalene-methacrylic acid copolymer, a vinylnaphthalene-acrylic acid copolymer, an alkyl acrylate-acrylic acid copolymer, an alkyl methacrylate-methacrylic acid copolymer, a styrene-alkyl methacrylate-methacrylic acid copolymer, a styrene-alkyl acrylate-acrylic acid copolymer, a styrene-phenyl methacrylate-methacrylic acid copolymer, and a styrene-cyclohexyl methacrylate-methacrylic acid copolymer. A monomer having a polyoxyethylene group or a hydroxyl group may also be copolymerized with the above polymers.

As the above-mentioned polymer dispersing agent have, for example, a weight average molecular weight of from 2,000 to 50,000.

These pigment dispersing agents may be used alone or in combination of two or more kinds. Although the addition amount of the pigment dispersing agent varies largely depending on the types of the pigments, the addition amount thereof is generally in the range of from 0.1% by weight to 100% by weight with respect to the amount of the pigment.

A pigment capable of self-dispersing in water can also be used as a colorant. The pigment capable of self-dispersing in water used in the present invention refers to the pigment that has a large number of water-solubilizing groups on the surface of the pigment and is capable of dispersing in water without the presence of a polymer dispersant. The pigment capable of self-dispersing in water is practically obtained by subjecting a common so-called pigment to surface modification treatments such as an acid or a base treatment, a coupling agent treatment, a polymer graft treatment, a plasma treatment or a redox treatment.

In addition to the above surface-modified pigments, commercially available pigments such as CAB-O-JET-200, CAB-O-JET-300, IJX-157, CAB-O-JET-250, CAB-O-JET-260, CAB-O-JET-270, IJX-444 and IJX-55 (manufactured by Cabot Corporation), and MICROJET BLACK CW-1 and CW-2 (manufactured by Orient Chemical Industries, Ltd.) may also be used as a pigment capable of self-dispersing in water.

The above self-dispersing pigments are preferably a pigment having at least a functional group of sulfonic acid, a sulfonate, a carboxylic acid, or a carboxylate on the surface thereof, and more preferably a pigment having a functional group of at least a carboxylic acid or a carboxylate on the surface thereof.

A pigment coated with a resin may also be used as the colorant. Such a pigment is called as a microcapsule pigment, which include commercially available microcapsule pigments manufactured by Dainippon Ink & Chemicals, Inc. and Toyo Ink MFG Co., Ltd. as well as the microcapsule pigments prepared for use in the invention.

A resin dispersing-type pigment composed of the above pigment to which a polymer substance is adsorbed or chemically bonded can also be used.

Other examples of the recording materials include dyes such as a hydrophilic anionic dye, direct dye, cationic dye, reactive dye, high molecular dye and oil-soluble dye, wax powder, resin powder or emulsions colored with a dye, fluorescent dye or fluorescent pigment, infrared absorber, ultraviolet absorber, magnetic materials such as ferromagnetic materials represented by ferrite, magnetite and others, semiconductors and photo catalysts represented by titanium oxide, zinc oxide and others, and other organic and inorganic particles of an electronic material.

The content (density) of the recording material is, for example, from 5% by weight to 30% by weight with respect to the amount of the ink.

The volume average particle size of the colorant is, for example, from 10 nm to 1,000 nm.

The volume average particle size of the colorant refers to the particle size of the colorant itself, or when an additive such as a dispersing agent is attached to the colorant, the particle size including the attached additive. In the invention, as the device for measurement of the volume average particle size, MICROTRUC UPA particle size analysis meter 9340 (produced by Leeds & Northrup Corp.) is used. The measurement is carried out according to the predetermined method with 4 ml of an ink put into a measuring cell. As the parameters to input for the measurement, the viscosity of the ink for an inkjet and the density of the recording material are used as the viscosity and the density of dispersed particles, respectively.

Next, a water-soluble organic solvent will be mentioned. As a water-soluble organic solvent, polyhydric alcohols, polyhydric alcohol derivatives, nitrogen-containing solvents, alcohols, sulfur-containing solvents, and the like may be used.

Specific examples of the polyhydric alcohols include sugar alcohols such as ethylene glycol, diethylene glycol, propylene glycol, butylene glycol, triethylene glycol, 1,5-pentane diol, 1,2-hexane diol, 1,2,6-hexane triol, glycerin, trimethylolpropane and xylitol; and saccharides such as xylose, glucose and galactose.

Specific examples of the polyhydric alcohol derivatives include ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, propylene glycol monobutyl ether, dipropylene glycol monobutyl ether, and the ethylene oxide adduct of diglycerol.

Specific examples of the nitrogen-containing solvents include pyrrolidone, N-methyl-2-pyrrolidone, cyclohexyl pyrrolidone, and triethanol amine. Specific examples of the alcohols include ethanol, isopropyl alcohol, butyl alcohol and benzyl alcohol. Specific examples of the sulfur-containing solvents include thiodiethanol, thiodiglycerol, sulfolane, and dimethyl sulfoxide.

Propylene carbonates, ethylene carbonates, or the like may also be used as the water-soluble organic solvent.

The water-soluble organic solvent may be used one or more kinds thereof. The content of the water-soluble organic solvent to be used is, for example, from 1% by weight to 70% by weight.

Next, water will be explained. As the water, ion exchange water, ultra pure water, distilled water or ultrafiltrated water are preferably used in order to prevent introduction of impurities.

Next, other additives will be explained. A surfactant may be added to the ink.

As the surfactants, various kinds of anionic surfactants, nonionic surfactants, cationic surfactants, amphoteric surfactants and the like may be used, and the anionic surfactants and the nonionic surfactants are preferably used.

Specific examples of the anionic surfactants include an alkylbenzenesulfonate, alkylphenylsulfonate, alkylnaphthalenesulfonate, higher fatty acid salt, sulfuric acid ester salt of higher fatty acid ester, sulfonic acid salt of higher fatty acid ester, sulfuric acid ester salt and sulfonic acid salt of higher alcohol ether, higher alkylsulfosuccinate, polyoxyethylene alkyl ethercarboxylate, polyoxyethylene alkyl ethersulfate, alkylphosphate and polyoxyethylene alkyl etherphosphate, and dodecylbenzenesulfonate, isopropylnaphthalenesulfonate, monobutylphenylphenol monosulfonate, monobutylbiphenylsulfonate, monobutylbiphenylsulfonate and dibutylphenylphenoldisulfonate are preferably used.

Specific examples of the nonionic surfactants include polyoxyethylene alkyl ether, polyoxyethylene alkylphenyl ether, polyoxyethylene fatty acid ester, sorbitan fatty acid ester, polyoxyethylene sorbitan fatty acid ester, polyoxyethylene sorbitol fatty acid ester, glycerol fatty acid ester, polyoxyethyleneglycerol fatty acid ester, polyglycerol fatty acid ester, sucrose fatty acid ester, polyoxyethylene alkylamine, polyoxyethylene fatty acid amide, alkylalkanol amide, polyethyleneglycol polypropyleneglycol block copolymer, acetylene glycol and polyoxyethylene adduct of acetylene glycol, and polyoxyethylene adducts such as polyoxyethylene nonyl phenyl ether, polyoxyethylene octyl phenyl ether, polyoxyethylene dodecyl phenyl ether, polyoxyethylene alkyl ether, polyoxyethylene fatty acid ester, sorbitan fatty acid ester, polyoxyethylene sorbitan fatty acid ester, fatty acid alkylol amide, polyethyleneglycol polypropyleneglycol block copolymer, acetylene glycol and polyoxyethylene adduct of acetylene glycol are preferably used.

In addition, silicone surfactants such as polysiloxane oxyethylene adducts, fluorine surfactants such as perfluoroalkyl carboxylate, perfluoroalkyl sulfonate and oxyethylene perfluoroalkyl ether, and biosurfactants such as spiculisporic acids, rhamnolipid and lysolecithin.

These surfactants may be used alone or in combination. The hydrophilicity/hydrophobicity balance (HLB) of the surfactant is preferably in the range of 3 to 20 in view of dissolvability or the like.

The amount of the surfactant to be added is preferably from 0.001% by weight to 5% by weight, and is more preferably from 0.01% by weight to 3% by weight.

Further, other various additives can be added to the ink, such as a permeating agent for adjusting permeating property of the ink, compounds such as polyethylene imine, polyamines, polyvinyl pyrrolidone, polyethylene glycol, ethyl cellulose and carboxy methyl cellulose, for controlling ink ejection property, and alkali metal compounds such as potassium hydroxide, sodium hydroxide and lithium hydroxide for adjusting conductivity and pH of the ink. As needed, a pH buffer, an antioxidant, a mildew preventing agent, a viscosity adjusting agent, a conductive agent, an ultraviolet ray absorbing agent, a chelating agent or the like can also be added.

Preferred characteristics of the ink will be described. First, the surface tension of the ink is preferably from 20 mN/m to 45 mN/m.

Here, the value as the surface tension is measured under the conditions of 23° C. and 55% RH by the use of a Willhermy type surface tensiometer (produced by Kyowa Interface Science Co., Ltd.) is used.

The ink viscosity is, for example, from 1.5 mPa·s to 30 mPa·s.

The viscosity here is determined as a value measured by using RHEOMAT 115 (manufactured by Contraves), at a measuring temperature of 23° C. and a shearing rate of 1400 $s^{-1}$.

The ink composition is not particularly limited to the above structure, and may include other functional materials than the recording material, such as a liquid crystal material or an electronic material.

In the above embodiments, a full-color image is recorded on the recording medium 8 by selectively ejecting the ink droplets 20A of black, yellow, magenta and cyan from the ink jet recording heads 20, according to image data. However, such a method is not only related to the recording of characters or images on recording mediums, but is also applicable to all kinds of the droplet ejection (spraying) apparatuses that are used in industrial fields.

Further, in the above embodiment, the cleaning aid particles 21 are supplied from the cleaning aid particle supply unit 23 to the ink receiving particles 16D remaining on the intermediate transfer member 12. However, the ink receiving particles 16 to which the cleaning aid particles are externally added in advance may also be used. In such an embodiment, the amount of the cleaning aid particles 21 to be externally added is, for example, preferably from 0.01% or about 0.01% to 5% or about 5% (preferably from 0.1% or about 0.1% to 2.5% or about 2.5%). As described above, also in this embodiment, the cleaning performance for the ink receiving particles 16D remaining on the intermediate transfer member 12 can be enhanced, and image defects (ghost) due to the residual particles can be prevented.

EXAMPLES

Hereinafter, the invention will be explained with reference to examples in detail, but the invention is not limited to these examples.

Preparation of Ink Receiving Particles

—Ink Receiving Particles A— styrene/2-ethylhexyl methacrylate/acrylic acid copolymer (ratio of polar monomer; 40% by mole): 94 parts by weight;

styrene/2-ethylhexyl methacrylate/acrylic acid copolymer (ratio of polar monomer; 5% by mole): 5 parts by weight;

Paraffin wax (OX-3215/manufactured by Nippon Seiro Co., Ltd.): 1 part by weight.

The above materials are stirred and mixed by a Henschel mixer to form a material to be kneaded. Thereafter, the material is placed in an extruder and melt-kneaded. The resultant kneaded product is cooled and pulverized by a jet mill. The obtained particles are classified by using an airflow classifier.

Next, to 100 parts by weight of the obtained particles, are added 0.9 parts by weight of amorphous silica (AEROSIL TT600; sphere equivalent average particle diameter of 0.04 μm, manufactured by Degussa), and 0.1 part by weight of amorphous silica (AEROSIL OX50; sphere equivalent average particle diameter of 0.04 μm, manufactured by Degussa), and stirred and mixed to obtain particles having a sphere equivalent average particle diameter of 5.5 μm. Thus, ink receiving particles A are obtained.

—Ink Receiving Particles B— styrene/n-butylacrylate/acrylic acid copolymer (ratio of polar monomer; 50 mol %): 100 parts by weight;

Sodium hydroxide (10% aqueous solution): 75 parts by weight;

2-propanol: 1,000 parts by weight

The above materials are stirred and mixed to form a mixed solution. The solvent is removed from the obtained mixed solution by means of a freeze dryer to obtain a solid component.

The above solid component: 94 parts by weight;

Amorphous polyester resin (ratio of polar monomer; 1 mol %): 5 parts by weight;

Paraffin wax (OX-3215/manufactured by Nippon Seiro Co., Ltd.): 1 part by weight.

The above materials are mixed and stirred by a Henschel mixer to form a material to be kneaded. Thereafter, the material is placed in an extruder and melt-kneaded. The resultant kneaded product is cooled, and subsequently pulverized by a jet mill. The obtained particles are classified by using an airflow classifier.

Next, to 100 parts by weight of the obtained particles, are added, 0.25 parts by weight of amorphous silica (AEROSIL TT600; sphere equivalent average particle diameter of 0.04 μm, manufactured by Degussa), and 0.75 parts by weight of amorphous silica (AEROSIL OX50; sphere equivalent average particle diameter of 0.04 μm, manufactured by Degussa), and stirred and mixed to obtain particles having a sphere equivalent average particle diameter of 8.5 μm. Thus, ink receiving particles B are obtained.

—Ink Receiving Particles C— styrene/n-butylacrylate/acrylic acid copolymer (ratio of polar monomer; 80 mol %): 96 parts by weight;

Amorphous polyester resin (ratio of polar monomer; 1 mol %): 3 parts by weight;

Paraffin wax (OX-3215/manufactured by Nippon Seiro Co., Ltd.): 1 part by weight.

The above materials are mixed and stirred by a Henschel mixer to form a material to be kneaded. Thereafter, the material is placed in an extruder and melt-kneaded. The resultant kneaded product is cooled, and subsequently pulverized by a jet mill. The obtained particles are classified by using an airflow classifier.

Next, to 100 parts by weight of the obtained particles, are added 0.25 parts by weight of amorphous silica (AEROSIL TT600; sphere equivalent average particle diameter of 0.04 μm, manufactured by Degussa), and 0.75 parts by weight of amorphous silica (AEROSIL OX50; sphere equivalent average particle diameter of 0.04 μm, manufactured by Degussa), and stirred and mixed to obtain particles having a sphere equivalent average particle diameter of 4.2 μm. Thus, ink receiving particles C are obtained.

—Ink Receiving Particles D— styrene/n-butylacrylate/acrylic acid copolymer (ratio of polar monomer; 90 mol %): 96 parts by weight;

Amorphous polyester resin (ratio of polar monomer; 1 mol %): 3 parts by weight;

Paraffin wax (OX-3215/manufactured by Nippon Seiro Co., Ltd.): 1 part by weight.

The above materials are mixed and stirred by a Henschel mixer to form a material to be kneaded. Thereafter, the material is placed in an extruder and melt-kneaded. The resultant kneaded product is cooled, and subsequently pulverized by a jet mill. The obtained particles are classified by using an airflow classifier.

Next, to 100 parts by weight of the obtained particles, are added, 0.25 parts by weight of amorphous silica (AEROSIL TT600; sphere equivalent average particle diameter of 0.04 μm, manufactured by Degussa), and 0.75 parts by weight of amorphous silica (AEROSIL OX50; sphere equivalent average particle diameter of 0.04 μm, manufactured by Degussa), and stirred and mixed to obtain particles having a sphere equivalent average particle diameter of 6.3 μm. Thus, ink receiving particles D are obtained.

—Ink Receiving Particles E— styrene/n-butylacrylate/acrylic acid copolymer (ratio of polar monomer; 17.5 mol %): 100 parts by weight;

Sodium hydroxide (10% aqueous solution): 17 parts by weight;

2-propanol: 1,000 parts by weight

The above materials are stirred and mixed to form a mixed solution. The solvent is removed from the obtained mixed solution by means of a freeze dryer to obtain a solid component.

The above solid component: 94 parts by weight;

Amorphous polyester resin (ratio of polar monomer; 1 mol %): 5 parts by weight;

Paraffin wax (OX-3215/manufactured by Nippon Seiro Co., Ltd.): 1 part by weight.

The above materials are stirred and mixed by a Henschel mixer to form a material to be kneaded. Thereafter, the material is placed in an extruder and melt-kneaded. The resultant kneaded product is cooled, and subsequently pulverized by a jet mill. The obtained particles are classified by using an airflow classifier.

Next, to 100 parts by weight of the thus obtained particles, are added 0.05 parts by weight of amorphous silica (AEROSIL TT600; sphere equivalent average particle diameter of 0.04 μm, manufactured by Degussa), and 0.05 parts by weight of amorphous silica (AEROSIL OX50; sphere equivalent average particle diameter of 0.04 μm, manufactured by Degussa), and stirred and mixed to obtain particles having a sphere equivalent average particle diameter of 7.4 μm. Thus, ink receiving particles E are obtained.

—Ink Receiving Particles F— styrene/n-butylacrylate/acrylic acid copolymer (ratio of polar monomer; 7.5 mol %): 100 parts by weight;

Sodium hydroxide (10% aqueous solution): 16 parts by weight;

2-propanol: 1,000 parts by weight

The above materials are stirred and mixed to form a mixed solution. The solvents are removed from the obtained mixed solution by means of a freeze dryer to obtain a solid component.

The above solid component: 94 parts by weight;

Amorphous polyester resin (ratio of polar monomer; 1 mol %): 5 parts by weight;

Paraffin wax (OX-3215/manufactured by Nippon Seiro Co., Ltd.): 1 part by weight.

The above materials are mixed and stirred by a Henschel mixer to form a material to be kneaded. Thereafter, the material is placed in an extruder and melt-kneaded. The resultant kneaded product is cooled, and subsequently pulverized by a jet mill. The obtained particles are classified by using an airflow classifier.

Next, to 100 parts by weight of the thus obtained particles, are added 0.25 parts by weight of amorphous silica (AEROSIL TT600; sphere equivalent average particle diameter of 0.04 μm, manufactured by Degussa), and 0.75 parts by weight of amorphous silica (AEROSIL 200; sphere equivalent average particle diameter of 0.012 μm, manufactured by Degussa), and stirred and mixed to obtain particles having a sphere equivalent average particle diameter of 12.1 μm. Thus, ink receiving particles F are obtained.

—Ink Receiving Particles G— styrene/n-butylacrylate/acrylic acid copolymer (ratio of polar monomer; 60 mol %): 100 parts by weight;

Sodium hydroxide (10% aqueous solution): 20 parts by weight;

2-propanol: 1,000 parts by weight

The above materials are stirred and mixed to form a mixed solution. The solvent is removed from the obtained mixed solution by means of a freeze dryer to obtain a solid component.

The above solid component: 94 parts by weight;

Amorphous polyester resin (ratio of polar monomer; 1 mol %): 5 parts by weight;

Paraffin wax (OX-3215/manufactured by Nippon Seiro Co., Ltd.): 1 part by weight.

The above materials are stirred and mixed by a Henschel mixer to form a material to be kneaded. Thereafter, the material is placed in an extruder and melt-kneaded. The resultant kneaded product is cooled, and subsequently pulverized by a jet mill. The obtained particles are classified by using an airflow classifier.

Next, to 100 parts by weight of the obtained particles, is added 0.5 parts by weight of polymethyl methacrylate (PMMA) particles (sphere equivalent average particle diameter of 0.2 μm), and stirred and mixed. The resultant particles are heated to 70° C., followed by cooling to room temperature to prepare particles having a sphere equivalent average particle diameter of 6.1 μm. Thus, ink receiving particles G are obtained.

—Ink Receiving Particles H— styrene/2-ethylhexyl methacrylate/acrylic acid copolymer (ratio of polar monomer; 40 mol %): 94 parts by weight;

styrene/2-ethylhexyl methacrylate/acrylic acid copolymer (ratio of polar monomer; 5 mol %): 5 parts by weight;

Paraffin wax (OX-3215/manufactured by Nippon Seiro Co., Ltd.): 1 part by weight.

The above materials are stirred and mixed by a Henschel mixer to form a material to be kneaded. Thereafter, the material is placed in an extruder and melt-kneaded. The resultant kneaded product is cooled, and subsequently pulverized by a jet mill. The obtained particles are classified by using an airflow classifier.

Next, to 100 parts by weight of the obtained particles, are added 1 part by weight of polystyrene particles (sphere equivalent average particle diameter of 0.2 μm) and 0.1 part by weight of amorphous silica (AEROSIL OX50; sphere equivalent average particle diameter of 0.04 μm, manufactured by Degussa), and stirred and mixed to obtain particles having a sphere equivalent average particle diameter of 6.2 μm. Thus, ink receiving particles H are obtained.

—Ink Receiving Particles I— styrene/2-ethylhexyl methacrylate/acrylic acid copolymer (ratio of polar monomer; 40 mol %): 94 parts by weight;

styrene/2-ethylhexyl methacrylate/acrylic acid copolymer (ratio of polar monomer; 5 mol %): 5 parts by weight;

Paraffin wax (OX-3215/manufactured by Nippon Seiro Co., Ltd.): 1.5 parts by weight.

The above materials are stirred and mixed by a Henschel mixer to form a material to be kneaded. Thereafter, the material is placed in an extruder and melt-kneaded. The resultant kneaded product is cooled, and subsequently pulverized by a jet mill. The obtained particles are classified by using an airflow classifier to obtain particles having a sphere equivalent average particle diameter of 5.2 μm. Thus, ink receiving particles I are obtained.

—Ink Receiving Particles J— styrene/n-butylacrylate/acrylic acid copolymer (ratio of polar monomer; 50 mol %): 100 parts by weight;

Sodium hydroxide (10% aqueous solution): 75 parts by weight;

2-propanol: 1,000 parts by weight

The above materials are stirred and mixed to form a mixed solution. The solvents are removed from the obtained mixed solution by means of a freeze dryer to obtain a solid component.

The above solid component: 94 parts by weight;

Amorphous polyester resin (ratio of polar monomer; 1 mol %): 4 parts by weight;

Paraffin wax (OX-3215/manufactured by Nippon Seiro Co., Ltd.): 1 part by weight.

The above materials are stirred and mixed by a Henschel mixer to form a material to be kneaded. Thereafter, the material is placed in an extruder and melt-kneaded. The resultant kneaded product is cooled, and subsequently pulverized by a jet mill. The obtained particles are classified by using an airflow classifier to obtain particles having a sphere equivalent average particle diameter of 8.4 μm. Thus, ink receiving particles J are obtained.

Preparation of Ink

—Ink A—

Carbon black (CB) BLACK PEARLS L, manufactured by Cabot Corporation: 8% by weight;

Styrene/acrylic acid copolymer: 1% by weight;

Glycerol: 15% by weight;

Propylene glycol: 10% by weight;

1,2-hexane diol: 5% by weight;

OLFINE E1010 manufactured by Nisshin Chemical Industry Co., Ltd.: 1.5% by weight;

NaOH: appropriate amount;

Water: balance

The above components are adjusted to a pH value of 7.3 using NaOH to prepare Ink A. The surface tension of the ink is 31 mN/m.

—Ink B—

C. I Pigment Blue 15:3:7% by weight;

Styrene/acrylic acid copolymer: 2.5% by weight;

Glycerol: 10% by weight;

Propylene glycol: 10% by weight;

1,2-hexane diol: 5% by weight;

OLFINE E1010 manufactured by Nisshin Chemical Industry Co., Ltd.: 1.5% by weight;

NaOH: appropriate amount;

Water: balance

The above components are adjusted to a pH value of 8.5 using NaOH to prepare Ink B. The surface tension of the ink is 31 mN/m.

Preparation of Cleaning Aid Particles

—Cleaning Aid Particles A— styrene/n-butylacrylate/acrylic acid copolymer (ratio of polar monomer; 7.5 mol %): 100 parts by weight;

Amorphous silica (AEROSIL TT600, manufactured by Degussa): 0.25 parts by weight;

Amorphous silica (AEROSIL OX50, manufactured by Degussa): 0.75 parts by weight;

The above components are stirred and mixed to prepare particles having a sphere equivalent average particle diameter of 3 μm. Thus, cleaning aid particles A are obtained.

—Cleaning Aid Particles B—

PMMA particles having a sphere equivalent average particle diameter of 1.5 μm are prepared by classifying EPOSTER MA particles manufactured by Nippon Shokubai Co., Ltd. by an airflow classifier. Thus, cleaning aid particles B are obtained.

—Cleaning Aid Particles C—

Polystyrene particles having a sphere equivalent average particle diameter of 0.8 μm are prepared by classifying SX particles manufactured by Soken Chemical & Engineering Co., Ltd. by an airflow classifier. Thus, cleaning aid particles C are obtained.

—Cleaning Aid Particles D—

TEFLON (registered trademark) particles having a sphere equivalent average particle diameter of 2.5 μm are prepared by classifying TEFLON (registered trademark) 7A particles manufactured by DuPont by an airflow classifier. Thus, cleaning aid particles D are obtained.

—Cleaning Aid Particles E—

Polyvinylidene fluoride particles having a sphere equivalent average particle diameter of 0.2 μm are prepared by classifying KF#850 particles manufactured by Kureha Corporation by an airflow classifier. Thus, cleaning aid particles E are obtained.

—Cleaning Aid Particles F—

Acrylic particles having a sphere equivalent average particle diameter of 3 μm are prepared by classifying TECHPOLYMER (BM-30X) particles manufactured by Nippon Shokubai Co., Ltd. by an airflow classifier. Thus, cleaning aid particles F are obtained.

—Cleaning Aid Particles G— styrene/n-butylacrylate/acrylic acid copolymer (ratio of polar monomer; 50 mol %): 100 parts by weight;

Amorphous silica (AEROSIL TT600, manufactured by Degussa): 0.25 parts by weight;

Amorphous silica (AEROSIL OX50, manufactured by Degussa): 0.75 parts by weight

The above components are stirred and mixed to prepare particles having a sphere equivalent average particle diameter of 4 μm. Thus, cleaning aid particles G are obtained.

Examples 1 to 11 and Comparative Examples 1 and 2

The following evaluations are carried out using ink receiving particles, ink and ink cleaning aid particles in accordance with the conditions as shown in Table 1.

Evaluation

Ink receiving particles are dispersed on an intermediate transfer member by using a cake printer. Onto the intermediate transfer member to which the ink receiving particles have been dispersed, is ejected ink by using a piezo-type inkjet device to form line images. Onto the images thus obtained, OK KINFUJI paper (manufactured by Oji Paper Co., Ltd.) as a recording medium is press-contacted at a pressure of $3\times10^5$ Pa and heated at 90° C. for 1 minute. Thereafter, the cleaning aid particles are supplied to ink receiving particles remaining on the intermediate transfer member, and cleaning is performed by means of a doctor blade type cleaning device. The applied amount of the ink receiving particles, the ink and the cleaning aid particles, and the method of supplying the cleaning aid particles are determined as shown in Tables 1.

—Evaluation of Ghost—

Two different image patterns (an image pattern having an oblong solid pattern at the center of the paper, and a half-tone image pattern) are alternately printed on ten sheets of paper, successively. Defects in a non-image area of the last printed sample are evaluated according to the following criteria.

I: No defects

II: Defects are found but almost not distinguishable

III: Defects are found but no problem in practical use

IV: Defects are found but acceptable

V: Defects are clearly distinguishable

—Evaluation of Storability—

The evaluation of storability is conducted as follows.

Ink receiving particles are stored for 24 hours under the conditions of temperature of 25° C. and humidity of 85%. Thereafter, images formed by using the ink receiving particles and resultant images are evaluated according to the following criteria. The evaluation results are shown in Table 2.

I: No defects

II: Defects are found but almost not distinguishable

III: Defects are found but no problem in practical use

IV: Defects are found but acceptable

V: Defects are clearly distinguishable

TABLE 2-continued

| | Ghost | Storability |
|---|---|---|
| Example 4 | III | III |
| Example 5 | II | I |
| Example 6 | III | I |
| Example 7 | I | I |
| Example 8 | I | I |
| Example 9 | II | I |
| Example 10 | IV | II |
| Example 11 | IV | III |
| Comp. Example 1 | V | II |
| Comp. Example 2 | V | III |

It is understood from the above results that Examples of the invention show excellent effects of suppressing ghost and superior storability, as compared with those of Comparative Examples.

All publications, patent applications, and technical standards mentioned in this specification are herein incorporated by reference to the same extent as if each individual publication, patent application, or technical standard was specifically and individually indicated to be incorporated by reference.

What is claimed is:

1. A recording device comprising:

an intermediate transfer member;

a particle supply unit that supplies ink receiving particles that receive ink onto the intermediate transfer member;

an ink ejecting unit that ejects ink to the ink receiving particles that have been supplied onto the intermediate transfer member;

a transfer unit that transfers the ink receiving particles that have received the ink to a recording medium from the intermediate transfer member,

TABLE 1

| | Ink receiving particles | | | Ink | | Cleaning Aid Particles | | | | Ratio of Ink |
|---|---|---|---|---|---|---|---|---|---|---|
| | Type | Ratio of Polar Monomer (mol %) | Applied Amount ($g/m^2$) | Type | Supply Amount ($g/m^2$) | Type | Supply Method | Sphere Equivalent Average Particle Diameter (μm) | Applied Amount ($g/m^2$) | Receiving Particles to Cleaning Aid (%) |
| Example 1 | A | 40/5 | 6.3 | A | 5.6 | A | Electrostatic Method | 3 | 0.25 | 4.97 |
| Example 2 | B | 50 | 7.3 | B | 3.9 | B | Adhesion Method | 1.5 | 0.08 | 2.1 |
| Example 3 | C | 80 | 7.9 | A | 4.9 | C | Vibration Method | 0.8 | 0.21 | 3.7 |
| Example 4 | D | 90 | 4.2 | B | 6.2 | D | Cylinder Rotation Method | 2.5 | 0.20 | 5.8 |
| Example 5 | E | 17.5 | 5.2 | A | 7.1 | E | Adhesion Method | 0.2 | 0.005 | 0.2 |
| Example 6 | F | 7.5 | 5.8 | B | 3.3 | F | Vibration Method | 3 | 0.16 | 3.8 |
| Example 7 | A | 40/5 | 6.3 | A | 5.4 | G | Electrostatic Method | 4 | 0.10 | 2.6 |
| Example 8 | B | 50 | 6.5 | B | 3.3 | A | Electrostatic Method | 3 | 0.031 | 1.5 |
| Example 9 | G | 60 | 6.9 | A | 8.9 | External Addition to Ink Receiving Particles | | 0.2 | 0.035 | 1.51 |
| Example 10 | A | 40/5 | 6.3 | A | 5.6 | External Addition to Ink Receiving Particles | | 0.04 | — | 1.0 |
| Example 11 | H | 60 | 6.9 | A | 7.8 | External Addition to Ink Receiving Particles | | 0.2 | — | 1.1 |
| Comp. Example 1 | I | 40/5 | 5.8 | A | 5.6 | — | No Supply | — | — | 0 |
| Comp. Example 2 | J | 90 | 4.0 | B | 6.2 | — | No Supply | — | — | 0 |

TABLE 2

| | Ghost | Storability |
|---|---|---|
| Example 1 | I | I |
| Example 2 | I | I |
| Example 3 | II | II |

a cleaning unit that cleans the ink receiving particles remaining on the intermediate transfer member after the transfer of the ink receiving particles by the transfer unit; and a cleaning aid particle supply unit, provided between the transfer unit and the cleaning unit, that supplies cleaning aid particles, the cleaning aid particles being hydrophobic particles or liquid absorbing particles, and the cleaning aid particles having a sphere equivalent average particle diameter of from about 0.05 μm to about 5 μm.

2. The recording device according to claim 1, wherein the cleaning aid particles are hydrophobic particles.

3. The recording device according to claim 2, wherein the hydrophobic particles are at least one selected from the group consisting of hydrophobic resin particles, polyvinylidene fluoride particles, tetrafluoroethylene particles, aliphatic acid derivative particles and inorganic oxide particles.

4. The recording device according to claim 1, wherein the cleaning aid particles are liquid absorbing particles.

5. The recording device according to claim 4, wherein the liquid absorbing particles comprise organic resin containing polar monomers at an amount of from about 30 mol % to about 100 mol % with respect to the total amount of monomer components.

6. The recording device according to claim 1, wherein the supplied amount of the cleaning aid particles is from about 0.01% by weight to about 5% by weight with respect to the amount of the ink receiving particles.

* * * * *